US011365850B2

(12) United States Patent
Papa et al.

(10) Patent No.: US 11,365,850 B2
(45) Date of Patent: Jun. 21, 2022

(54) RETROFIT LED CANOPY LUMINAIRE ASSEMBLY AND METHOD OF INSTALLING SAME

(71) Applicant: LSI Industries, Inc., Cincinnati, OH (US)

(72) Inventors: Christopher Linn Papa, Liberty Township, OH (US); Richard Perry Abernethy, Greenville, SC (US); Eric Jon Mooar, Liberty Township, OH (US); Nikhil Kochar, Blue Ash, OH (US)

(73) Assignee: LSI Industries, Inc., Cincinnati, OH (US)

( * ) Notice: Subject to any disclaimer, the term of this patent is extended or adjusted under 35 U.S.C. 154(b) by 0 days.

(21) Appl. No.: 17/484,294

(22) Filed: Sep. 24, 2021

(65) Prior Publication Data

US 2022/0090742 A1 Mar. 24, 2022

Related U.S. Application Data

(60) Provisional application No. 63/082,890, filed on Sep. 24, 2020.

(51) Int. Cl.
*F21K 9/278* (2016.01)
*F21V 23/00* (2015.01)
(Continued)

(52) U.S. Cl.
CPC ..... *F21K 9/278* (2016.08); *F21K 9/232* (2016.08); *F21V 23/002* (2013.01); *F21Y 2115/10* (2016.08)

(58) Field of Classification Search
CPC ..... F21K 9/278; F21K 9/232; F21V 23/002; F21Y 2115/10
See application file for complete search history.

(56) References Cited

U.S. PATENT DOCUMENTS 5,662,407 A 9/1997 Fischer et al.
6,059,422 A 5/2000 Fischer et al.
(Continued)

OTHER PUBLICATIONS

LSI Industries Inc., Scottsdale Vertex Brochure, Canopy Luminaire, www.lsi-industries.com/vertex, 2018 (9 pages).
(Continued)

*Primary Examiner* — Bryon T Gyllstrom
*Assistant Examiner* — Christopher E Dunay
(74) *Attorney, Agent, or Firm* — Wood Herron & Evans LLP

(57) ABSTRACT

A retrofit LED canopy luminaire assembly is provided that is configured for mounting with a canopy fixture supported by a canopy deck and having a fixture base located beneath the canopy deck, a lamp socket housing operatively connected to, and extending upwardly from the fixture base and through the canopy deck, and a ballast housing located above the canopy deck and operatively connected to the lamp socket housing. The retrofit LED canopy luminaire assembly includes a retrofit adapter bracket, a retrofit LED canopy luminaire configured to be mounted to the retrofit adapter bracket, and a wire guide body supported within the lamp socket housing that is configured to route electrical leads extending outwardly from the retrofit LED canopy luminaire through the wire guide body and into the ballast housing.

25 Claims, 20 Drawing Sheets

(51) Int. Cl.
*F21K 9/232* (2016.01)
*F21Y 115/10* (2016.01)

(56) References Cited

U.S. PATENT DOCUMENTS

| | | | | |
|---|---|---|---|---|
| 6,168,300 | B1 | 1/2001 | Fischer et al. | |
| 6,422,720 | B2 | 7/2002 | Fischer et al. | |
| 6,497,499 | B1 | 12/2002 | Fischer et al. | |
| 2012/0044703 | A1* | 2/2012 | Wilson | F21V 21/04 362/365 |
| 2015/0267873 | A1* | 9/2015 | Price | F21S 8/026 362/432 |
| 2016/0010804 | A1* | 1/2016 | Barnetson | F21K 9/232 362/235 |
| 2016/0238196 | A1* | 8/2016 | Fondeur | F21S 8/085 |
| 2017/0370530 | A1* | 12/2017 | Chami | F21V 23/002 |
| 2018/0051854 | A1* | 2/2018 | Ossi | F21V 21/34 |
| 2019/0285259 | A1* | 9/2019 | Tickner | F21V 23/06 |
| 2022/0042663 | A1* | 2/2022 | Yang | F21V 15/01 |

OTHER PUBLICATIONS

LSI Industries Inc., Scottsdale Vertex, SCV, Features & Specifications, https://www.lsi-industries.com, 2020 (4 pages).
Jarvis Lighting, SCRT Series, Custom LED Retrofit Solutions, LED Lighting, https://www.jarvislighting.com/product/scrt-series/, retrieved on Sep. 22, 2020 (3 pages).
Jarvis Lighting, SCRT-320 Technical Specifications, SCRT-320 Petroleum Canopy LED Retrofit Kit—LSI Scottsdale* Retrofit, https://www.jarvislighting.com, Jan. 2019 (4 pages).
LSI Industries Inc., Scottsdale Series Brochure, Petroleum Canopy & Soffit Luminaire, www.lsi-industries.com, 2020 (4 pages).
LSI Industries Inc., Scottsdale SCM, Features & Specifications, https://www.lsi-industries.com, 2020 (4 pages).

* cited by examiner

RETROFIT LED CANOPY LUMINAIRE ASSEMBLY AND METHOD OF INSTALLING SAME

CROSS-REFERENCE TO RELATED APPLICATION

The present application claims the filing benefit of U.S. Provisional Application Ser. No. 63/082,890, filed Sep. 24, 2020, the disclosure of which is incorporated herein by reference in its entirety.

FIELD OF THE INVENTION

The present invention relates generally to luminaires and, more particularly, to light emitting diode ("LED") canopy luminaires.

BACKGROUND OF THE INVENTION

Canopy luminaires are known in the prior art for use in many lighting applications, including canopies located over fuel pumps at a petroleum service station, canopies located at store fronts for convenient stores, and canopies located at drive-through's of restaurants, for example.

One well-known canopy luminaire known in the art is the SCOTTSDALE® canopy luminaire that is commercially available from the Applicant of the present application, LSI Industries Inc., located in Cincinnati, Ohio. There are tens of thousands of SCOTTSDALE® canopy luminaires currently installed that use a high-intensity discharge ("HID") lamp for providing a downward and outward distribution of light at the location of the canopy luminaire. The HID lamp may be a metal-halide lamp, for example, or any other suitable HID lamp.

While the SCOTTSDALE® canopy luminaire utilizing an HID lamp provides a high-performance, energy-efficient and low maintenance lighting solution, the recent advance in light emitting diode ("LED") lighting technology has made LED-based lighting desirable as a replacement for HID lamp-based canopy luminaires. LED-based lighting technology is more energy efficient, has better lighting control and light-emitting characteristics, and is easier to service and maintain over HID-based canopy luminaires.

In view of the significant installed base of SCOTTSDALE® canopy luminaires utilizing HID lamps, there is a need in the industry, such as at petroleum service stations, to retrofit these HID-based canopy luminaires with LED-based lighting technology in a cost-effective manner.

SUMMARY OF THE INVENTION

The present invention overcomes the shortcomings and drawbacks of known approaches for retrofitting SCOTTSDALE® canopy luminaires utilizing HID lamps with LED-based lighting technology. While the invention will be discussed in connection with certain embodiments, it will be understood that the invention is not limited to these embodiments. On the contrary, the invention includes all alternatives, modifications, and equivalents as may be included within the spirit and scope of the invention.

According to one exemplary embodiment, a retrofit LED canopy luminaire assembly is provided that is configured for mounting with a canopy fixture supported by a canopy deck and having a fixture based located beneath the canopy deck, a lamp socket housing operatively connected to, and extending upwardly from the fixture base and through the canopy deck, and a ballast housing located above the canopy deck and operatively connected to the lamp socket housing.

According to one aspect of the present invention, the retrofit LED canopy luminaire assembly comprises a retrofit adapter bracket that defines a central opening therethrough and is configured to be mounted to the canopy deck and receive the fixture base within the central opening.

A retrofit LED canopy luminaire is configured to be mounted to the retrofit adapter bracket and has electrical leads that are electrically coupled to, and extend outwardly from the retrofit LED canopy luminaire.

A wire guide body is supported within the lamp socket housing and has at least one passageway extending therethrough that is configured to route the electrical leads extending outwardly from the retrofit LED campy luminaire through the wire guide body and into the ballast housing.

In one embodiment, the wire guide body includes a pair of at least partially separated passageways extending therethrough, with each of the pair of passageways being configured to route selected different ones of the electrical leads through the respective pair of passageways of the wire guide body and into the ballast housing.

According to one aspect, the pair of at least partially separated passageways include a common inlet located at one end of the pair of passageways and a pair of respective outlets located at remote opposite ends of the respective pair of passageways. The wire guide body may include a saddle portion located within the wire guide body proximate the common inlet, wherein the saddle portion separates the common inlet into the pair of at least partially separated passageways.

According to one embodiment of the present invention, the wire guide body includes a plurality of circumferentially spaced mounting pillars that extend in a direction parallel to a longitudinal axis of the wire guide body, with each of the mounting pillars being configured to frictionally engage with an inner cylindrical surface of the lamp socket housing. The lamp socket housing and the wire guide body may include respective cooperating keying structure that are configured to orient the wire guide body in a predetermined rotational orientation within the lamp socket housing.

A method of retrofitting a canopy luminaire having a canopy fixture supported by a canopy deck and including a fixture base located beneath the canopy deck, a lamp socket housing operatively connected to and extending upwardly from the fixture base and through the canopy deck, a lamp socket supported within the lamp socket housing, a high intensity discharge (HID) lamp mounted in the lamp socket, a reflector supported beneath the fixture base through which a portion of the HID lamp extends, a frame and lens assembly movably connected to the fixture base and enclosing the HID lamp, and a ballast housing located above the canopy deck and operatively connected to the lamp socket housing is provided.

According to one embodiment of the present invention, the method comprises the steps of disconnecting and removing the frame and lens assembly from the fixture base, removing the HID lamp from the lamp socket, removing the reflector from the fixture base, removing the lamp socket from the lamp socket housing, mounting a retrofit adaptor bracket defining a central opening therethrough to the canopy deck with the fixture base received within the central opening, supporting a wire guide body having at least one passageway extending therethrough within the lamp socket housing, providing a retrofit LED canopy luminaire having electrical leads that are electrically coupled to, and extend outwardly from, the retrofit LED canopy luminaire, routing the electrical leads extending outwardly from the retrofit LED canopy luminaire through the at least one passageway of the wire guide body and into the ballast housing, and mounting the retrofit LED canopy luminaire to the retrofit adaptor bracket.

Various additional features and advantages of the invention will become more apparent to those of ordinary skill in the art upon review of the following detailed description of the illustrative embodiments taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION OF THE INVENTION

Figure 1:
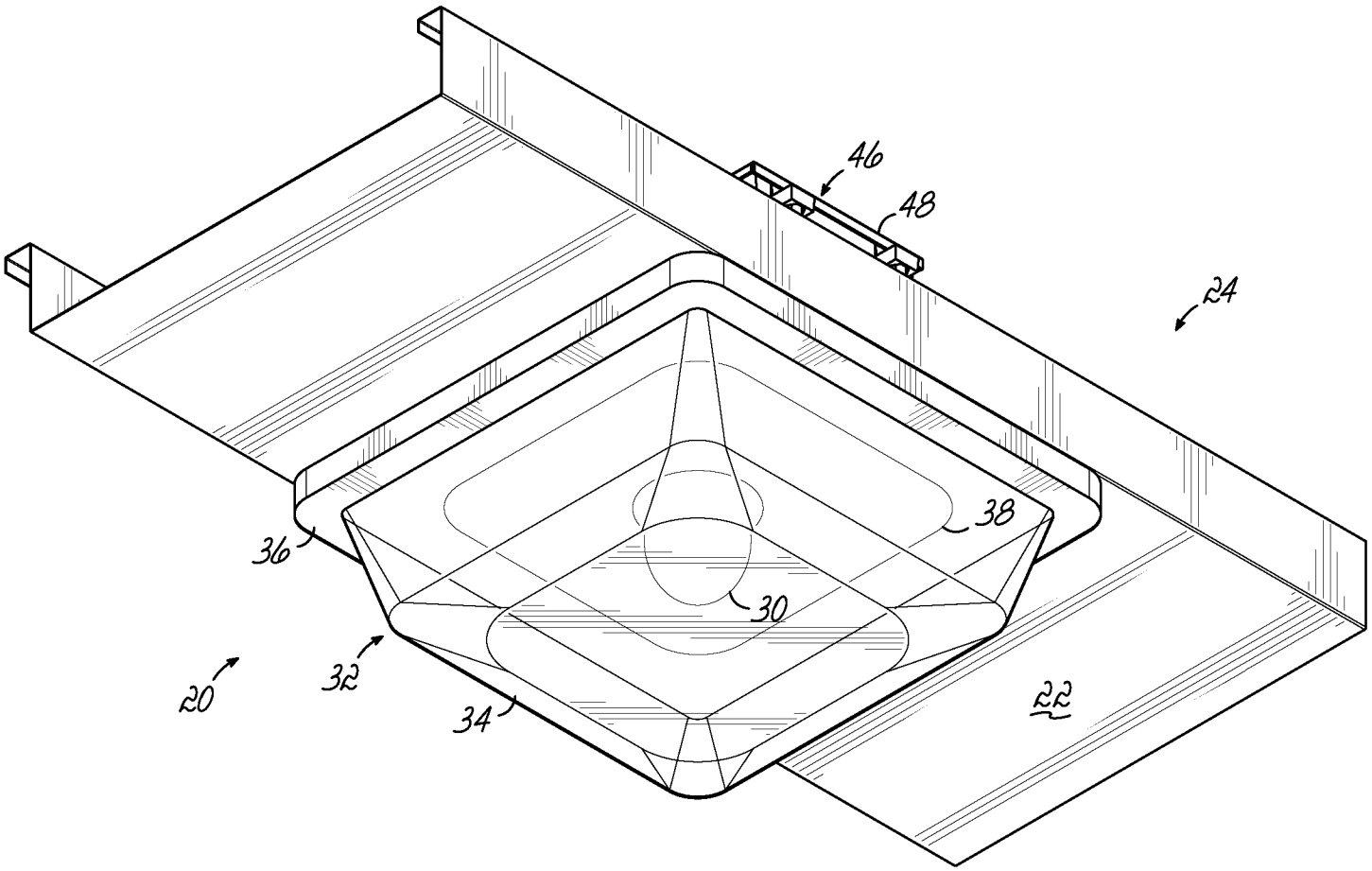
FIG. 1 PRIOR ART
FIG. 1 is a bottom perspective view of a prior art SCOTTSDALE® canopy luminaire utilizing an HID lamp to be retrofitted with an LED-based canopy luminaire in accordance with the principles of the present invention.

Referring now to the figures, and to FIGS. 1 and 2A-2C in particular, a well-known and widely used SCOTTSDALE® canopy luminaire 20 is shown mounted to a deck 22 of canopy 24, such as a canopy typically found located over fuel pumps at petroleum service stations.

As shown in FIGS. 1, 2A-2C, 4I and 4G, the SCOTTSDALE® canopy luminaire 20 includes a generally rectangular fixture base 26 (FIGS. 2A-2C and 4G) located beneath the canopy deck 22 and a lamp socket housing 28 (FIG. 4I) that extends upwardly from the fixture base 26 and through an opening (not shown) provided in the canopy deck 22. The fixture base 26 and the lamp socket housing 28 are typically integrally formed as a die-cast aluminum unit which is installed and supported by the canopy deck 22.

The SCOTTSDALE® canopy luminaire 20 shown in FIG. 1 utilizes a vertically oriented high intensity discharge ("HID") lamp 30, such as a metal-halide lamp, that is mounted to extend downwardly below the fixture base 26, with the light-emitting section of the HID lamp 30 being enclosed by a frame and lens assembly 32 that is hingedly connected to the fixture base 26. The lens 34 is typically made of glass, such as prismatic glass, and the lens frame 36 provided for supporting the glass lens 34 is typically made of an extruded plastic material. A reflector 38, such as a specular reflector, is mounted beneath the fixture base 26, with a base of the HID lamp 30 extending through an opening provided in the reflector 38 and electrically coupling to a lamp socket 40 (see FIG. 2C) that is supported within the lamp socket housing 28. The light-emitting section of the HID lamp 30 extends beneath the reflector 38 as shown in FIG. 1 to provide a uniform downward projection of light. The hinged connection of the frame and lens assembly 32 to the fixture base 26 allows the frame and lens assembly 32 to be pivoted from a closed position as shown in FIG. 1 to an open position pivoted away from the fixture base 26 about the cooperating hinge structure 42, 44 (see FIGS. 2A and 2B) located on the same respective sides of the lens frame 36 and fixture base 26 so that a user can access the HID lamp 30 mounted in the lamp socket 40 for removal and replacement thereof as may be necessary.

Figure 4A:
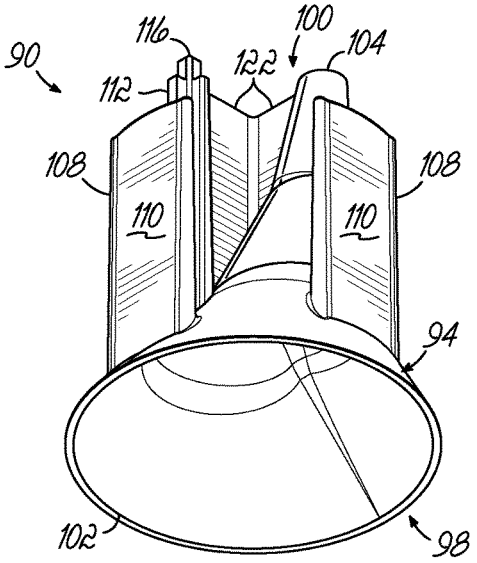
FIGS. 4A-4F illustrate various views of an exemplary wire guide for use in retrofitting the SCOTTSDALE® canopy luminaire of FIG. 1 with the retrofit LED canopy luminaire as shown in FIGS. 2G and 2H.
Figure 4B:
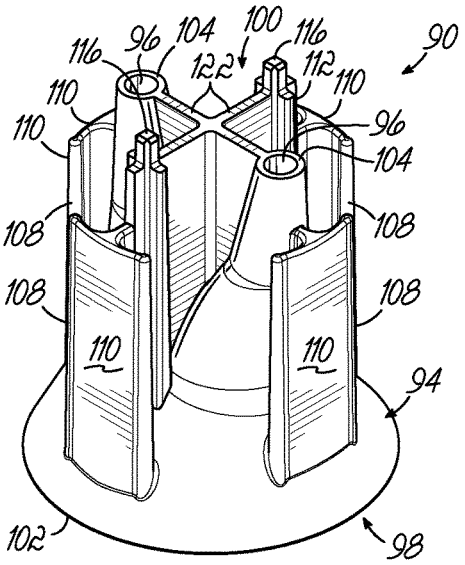
Figure 4C:
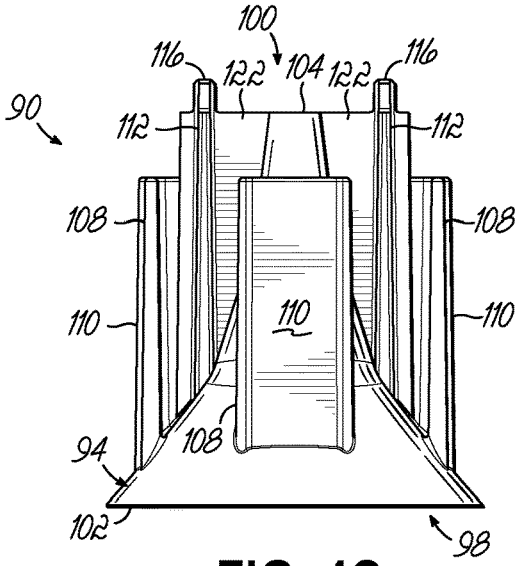
Figure 4D:
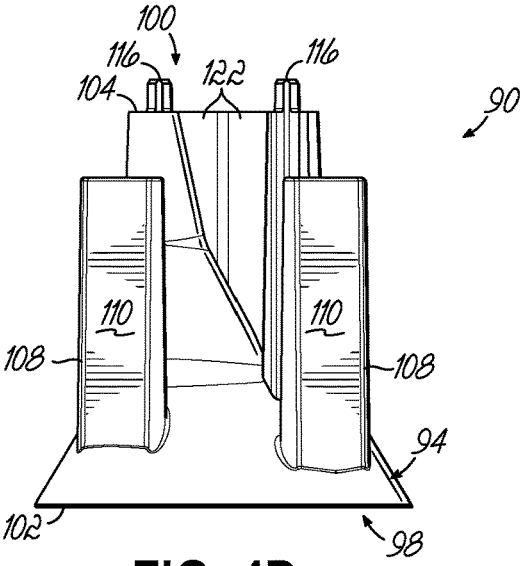
Figure 4E:
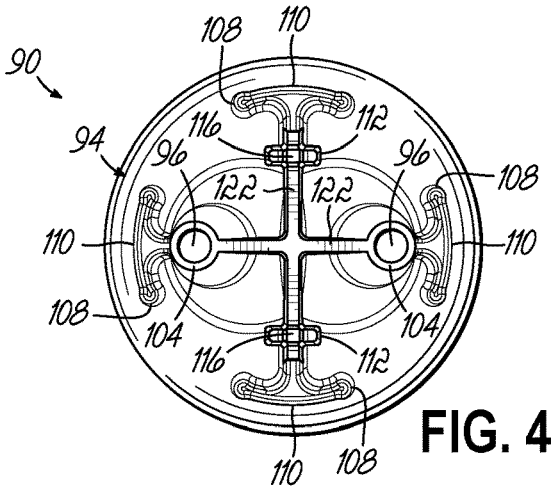
Figure 4F:
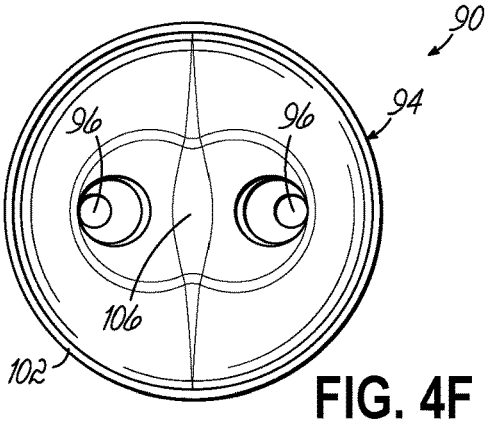
Figure 4G:
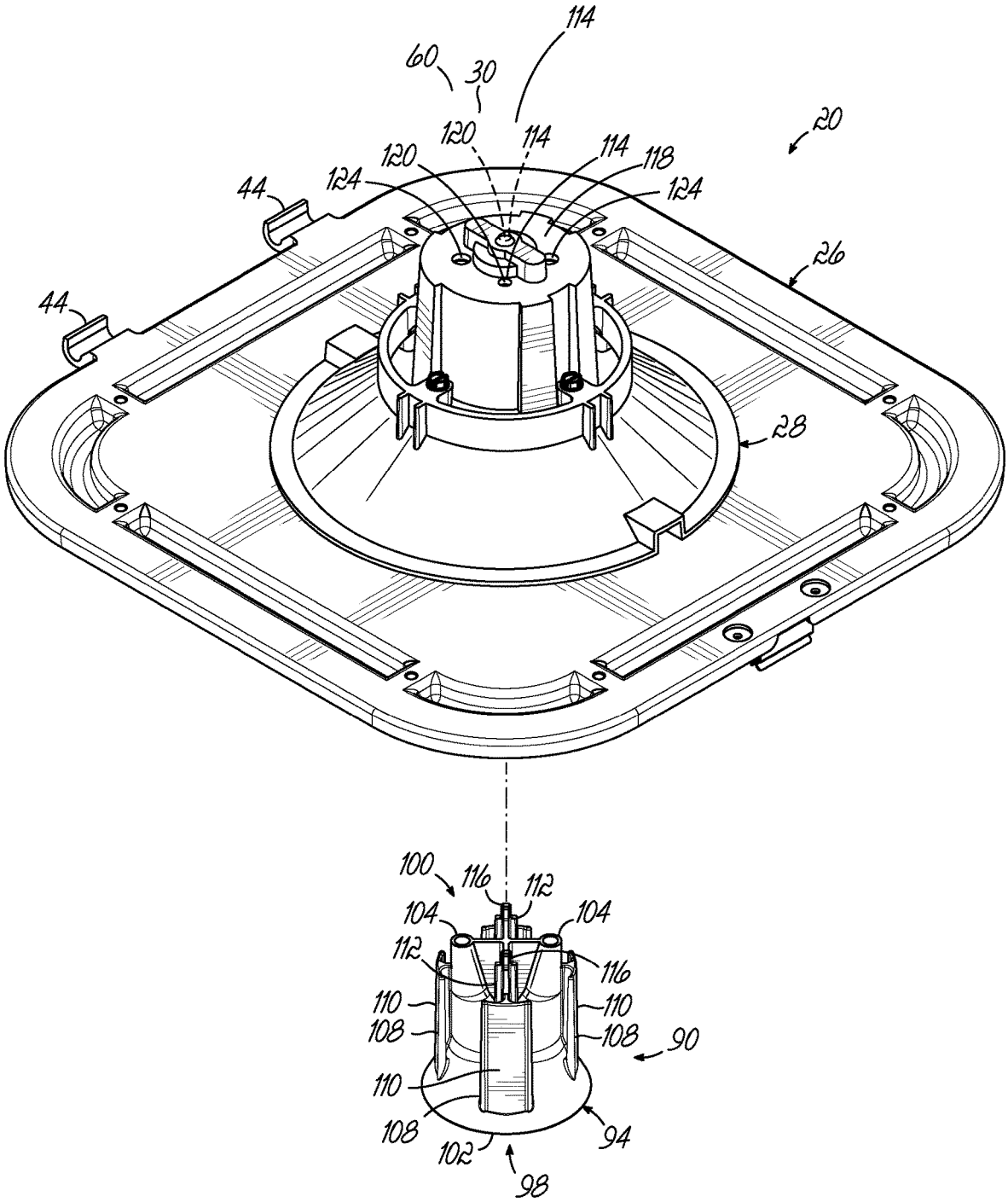
FIG. 4G illustrates mounting of the wire guide shown in FIG. 2F and FIGS. 4A-4F during retrofit of the SCOTTSDALE® canopy luminaire of FIG. 1 with the retrofit LED canopy luminaire as shown in FIGS. 2G and 2H.
Figure 4H:
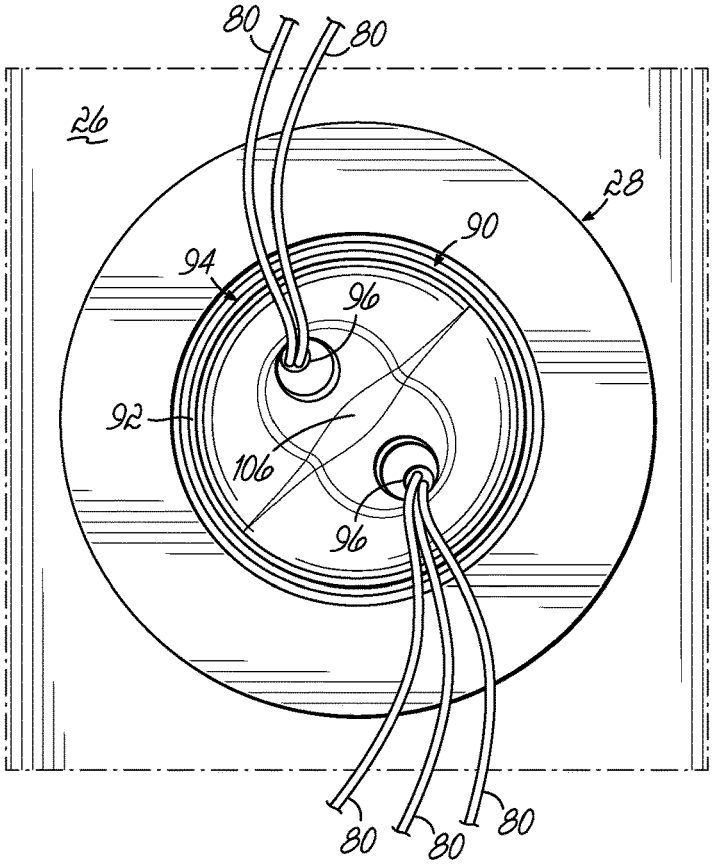
FIG. 4H is a bottom plan view of the wiring guide shown in FIGS. 4A-4G installed in the lamp socket housing of the SCOTTSDALE® canopy fixture shown in FIG. 4G.
Figure 4I:
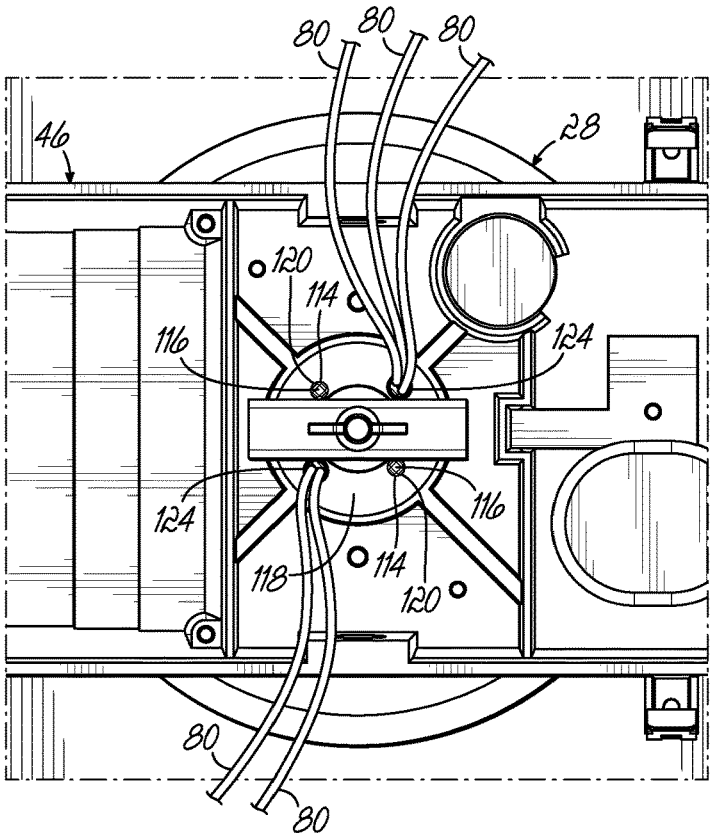
FIG. 4I is a top plan view of the SCOTTSDALE® canopy fixture shown in FIG. 4G, with electrical leads of the retrofit LED canopy luminaire shown extending through the lamp socket housing and into a ballast housing of the SCOTTSDALE® canopy luminaire of FIG. 1.
Figure 7:
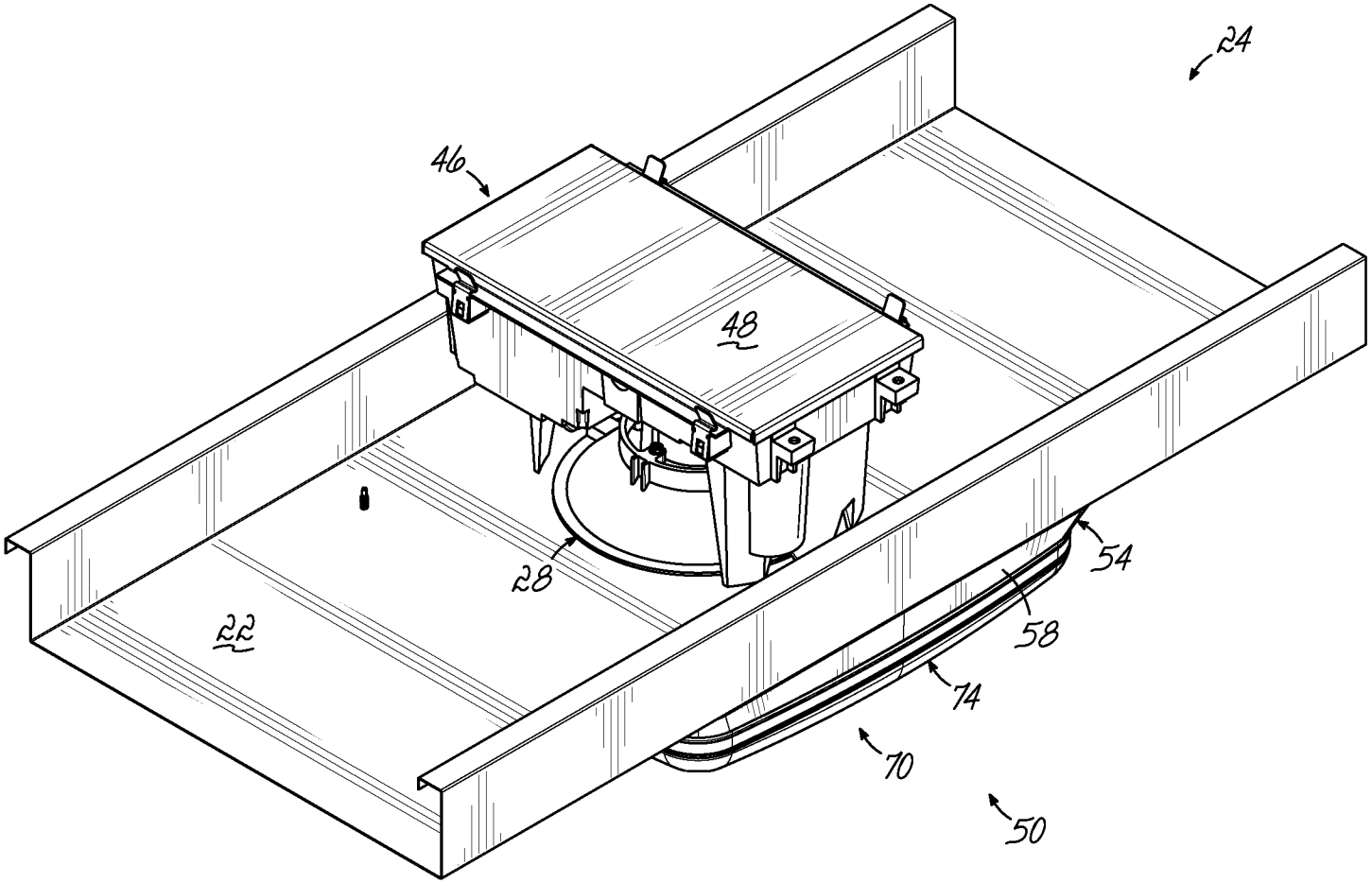
FIG. 7 is a top perspective view of the ballast housing of the SCOTTSDALE® canopy luminaire of FIG. 1, showing the ballast housing located above the canopy deck of the canopy shown in FIG. 1.
Figure 8:
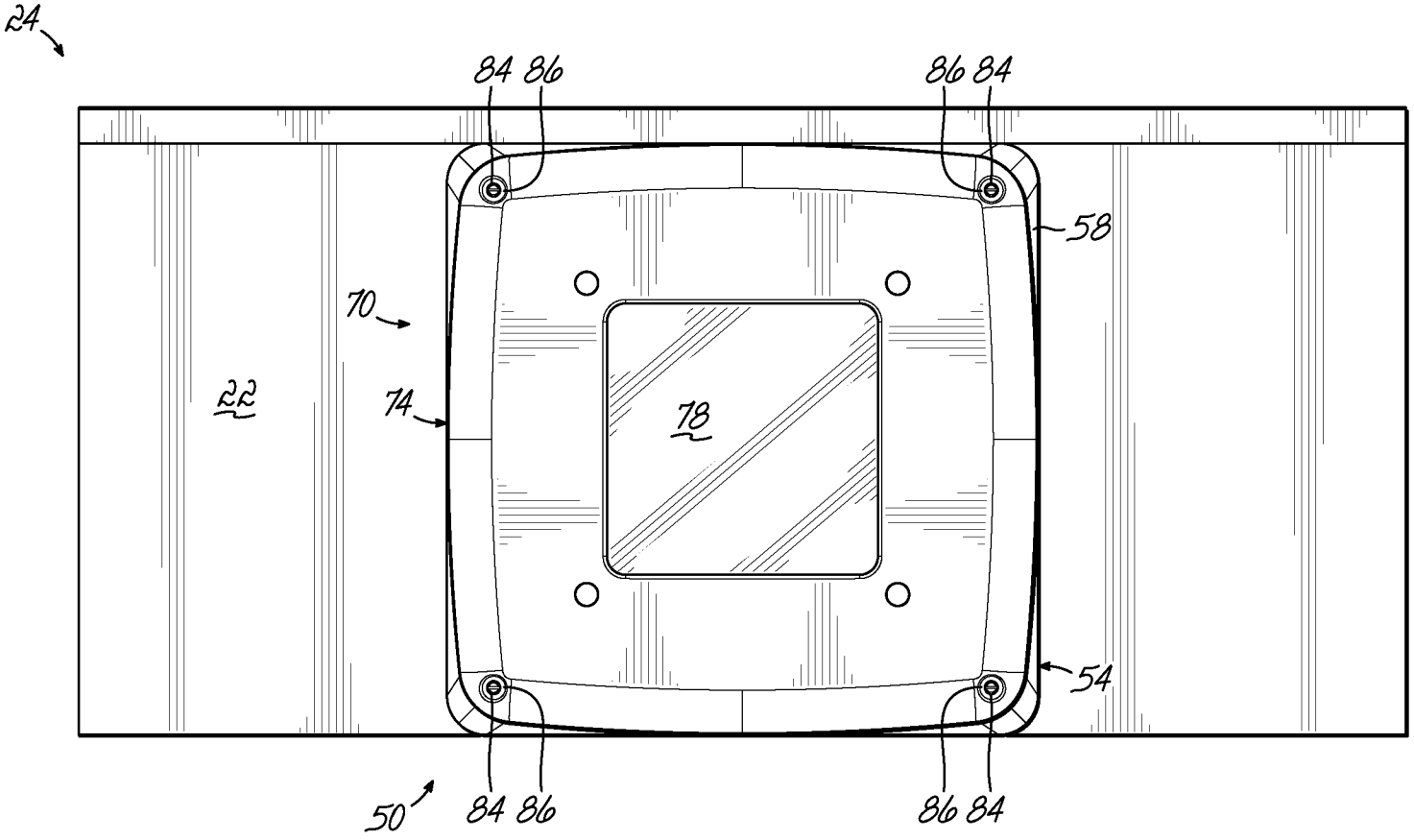
FIG. 8 is a bottom plan view of the installed retrofit LED canopy luminaire shown in FIGS. 5-7.

As in FIGS. 1, 4I and 7, the SCOTTSDALE® canopy luminaire 20 of FIG. 1 includes a ballast housing 46 that is mounted above the canopy deck 22 and is operatively connected to the lamp socket housing 28 as shown in FIG.

4I. The ballast housing 46 is also typically made of die-cast aluminum and defines one or more chambers for housing control components (not shown), such as a transformer, capacitor and ignitor, within the ballast housing 46 which is closed by a removable top cover 48 as shown in FIG. 7.

Details of the construction, assembly and operation of the SCOTTSDALE® canopy luminaire 20 shown in FIG. 1, including the ballast housing 46, may be found in U.S. Pat. Nos. 6,497,499, 6,059,422 and 5,662,407 to which the reader is referred, each assigned to the common Applicant and incorporated herein by reference in their respective entireties.

As will be described in greater detail below, while the SCOTTSDALE® canopy luminaire 20 has been found to provide superior lighting performance and robust reliability for its intended lighting applications, recent advances in LED lighting technology has made it desirable in the lighting industry to retrofit the HID lamp-based SCOTTSDALE® canopy luminaire 20 shown in FIG. 1 with an alternative LED-based lighting technology.

To that end, referring now to FIGS. 2-9, a retrofit method and retrofit LED canopy luminaire assembly 50 according to one embodiment of the present invention is shown and described in connection with FIGS. 2G, 2H and 5-7.

Figure 2A:
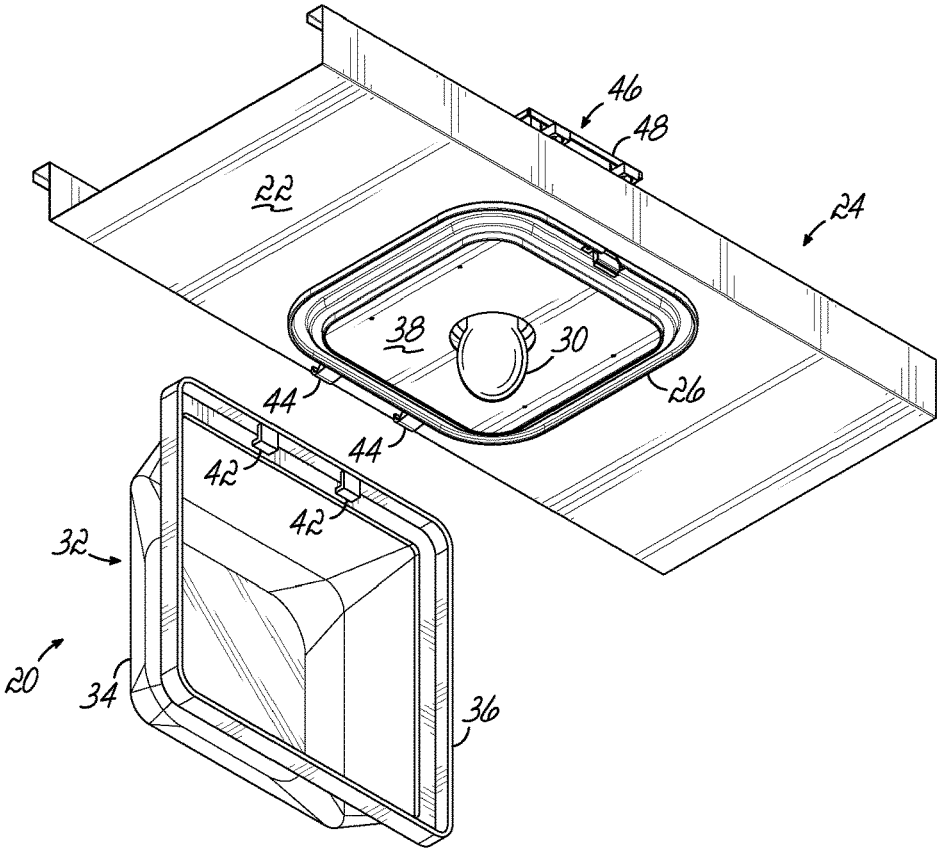
FIGS. 2A-2C illustrate disassembly of the SCOTTSDALE® canopy luminaire shown in FIG. 1 for retrofitting the canopy luminaire of FIG. 1 with a retrofit LED-based canopy luminaire in accordance with the principles of the present invention.
Figure 2B:
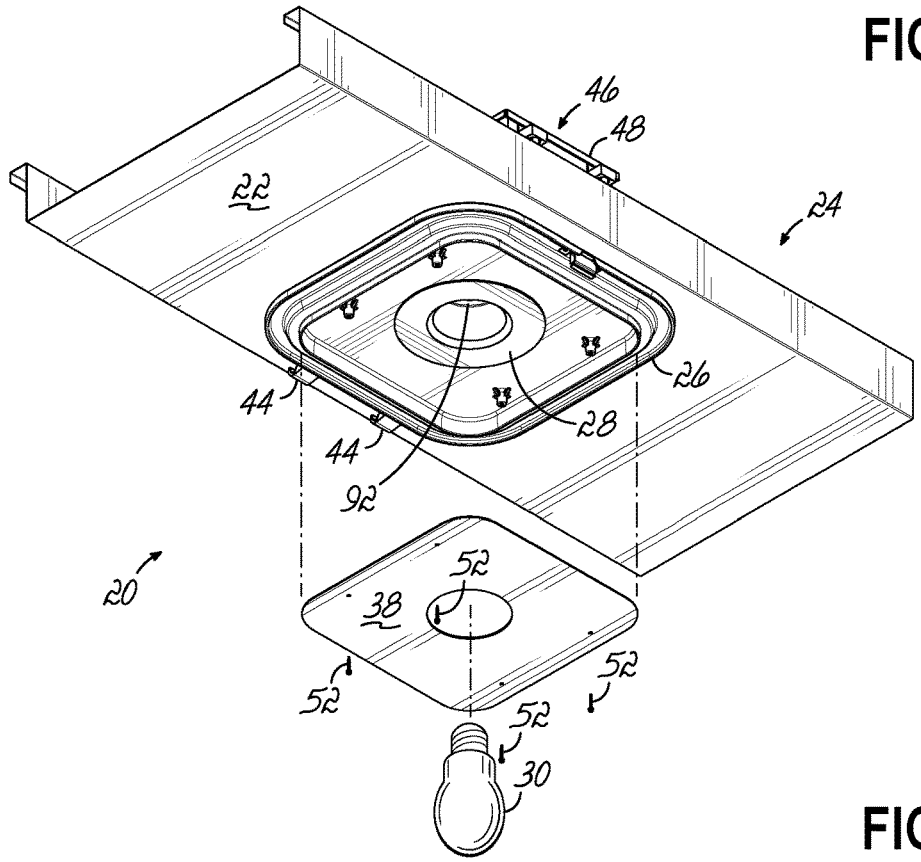
Figure 2C:
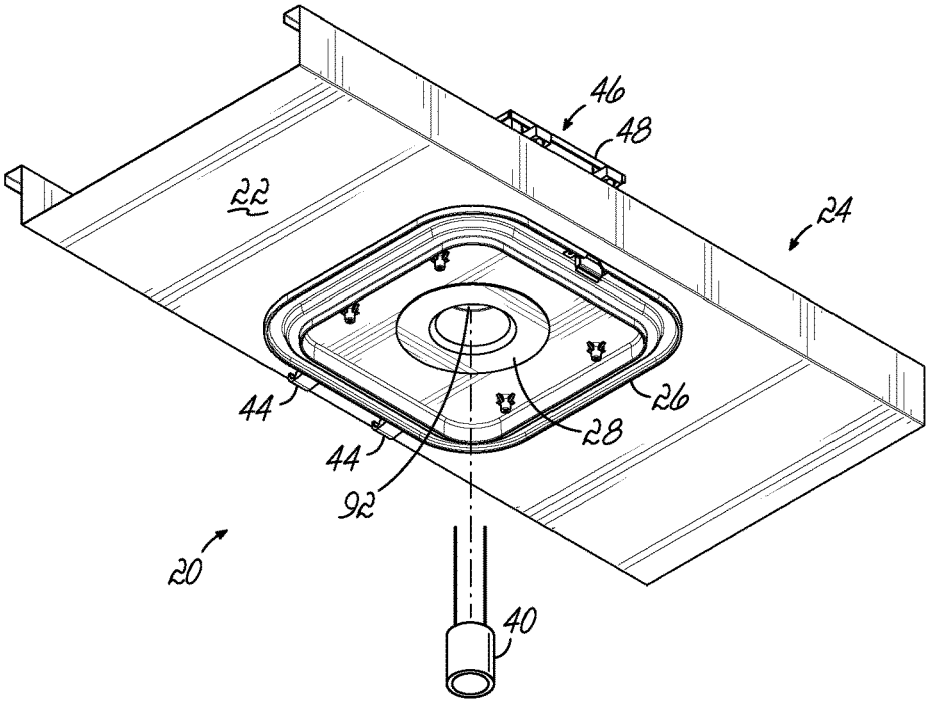
Figure 2D:
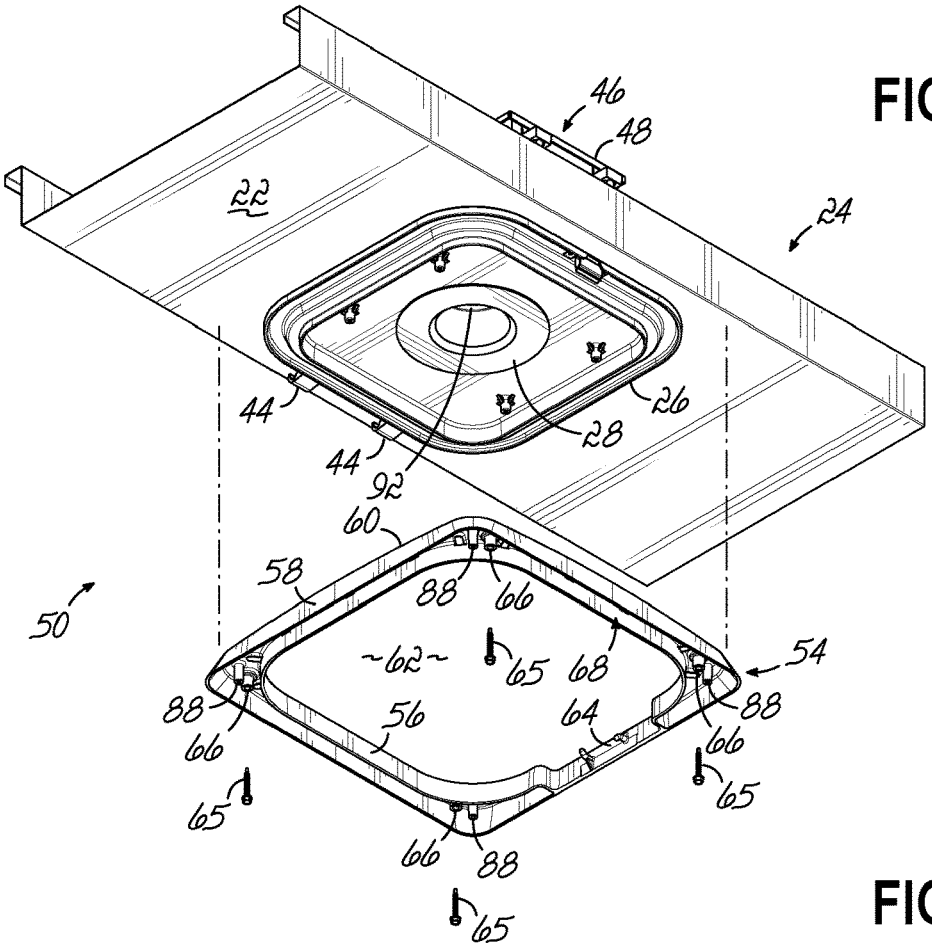
FIGS. 2D and 2E illustrate retrofitting of the canopy luminaire shown in FIG. 1 with alternative mounting of a reversible, retrofit adaptor bracket to the canopy deck according to alternative exemplary embodiments of the present invention.

According to one embodiment, the HID lamp-based SCOTTSDALE® canopy luminaire 20 shown in FIG. 1 is retrofitted with the retrofit LED canopy luminaire assembly 50 by first disconnecting and removing the frame and lens assembly 32 from the fixture base 26 of the SCOTTSDALE® canopy luminaire 20 as shown in FIG. 2A. Next, as shown in FIG. 2B, the HID lamp 30 and reflector 38 are removed from the fixture base 26 by unscrewing the HID lamp 30 from the lamp socket 20, and removing fasteners 52 used to secure the reflector 38 to the fixture base 26. Further disassembly of the SCOTTSDALE® canopy luminaire 20 is shown in FIG. 2C wherein the lamp socket 40 supported in the lamp socket housing 28 is disconnected and removed from the fixture base 26. Lastly, disassembly of the retrofit LED canopy luminaire 20 may optionally include removal of the control components (not shown) from the ballast housing 46. Alternatively, the control components (not shown) may be electrically disconnected and simply left remaining in the ballast housing 46.

As shown in FIGS. 2D, 2E and FIGS. 3A-3E, the retrofit LED canopy luminaire assembly 50 according to one embodiment includes an annular retrofit adaptor bracket 54 having a radially inward inner wall 56, a radially outward outer wall 58 and a connecting web 60 extending between the inner and outer walls 56, 58. The inner wall 56 of the retrofit adaptor bracket defines a generally rectangular opening 62 that extends through the retrofit adaptor bracket 54. As shown most clearly in FIGS. 3A and 3B, the opening 62 includes a notch 64 formed as part of the opening 62.

Figure 2E:
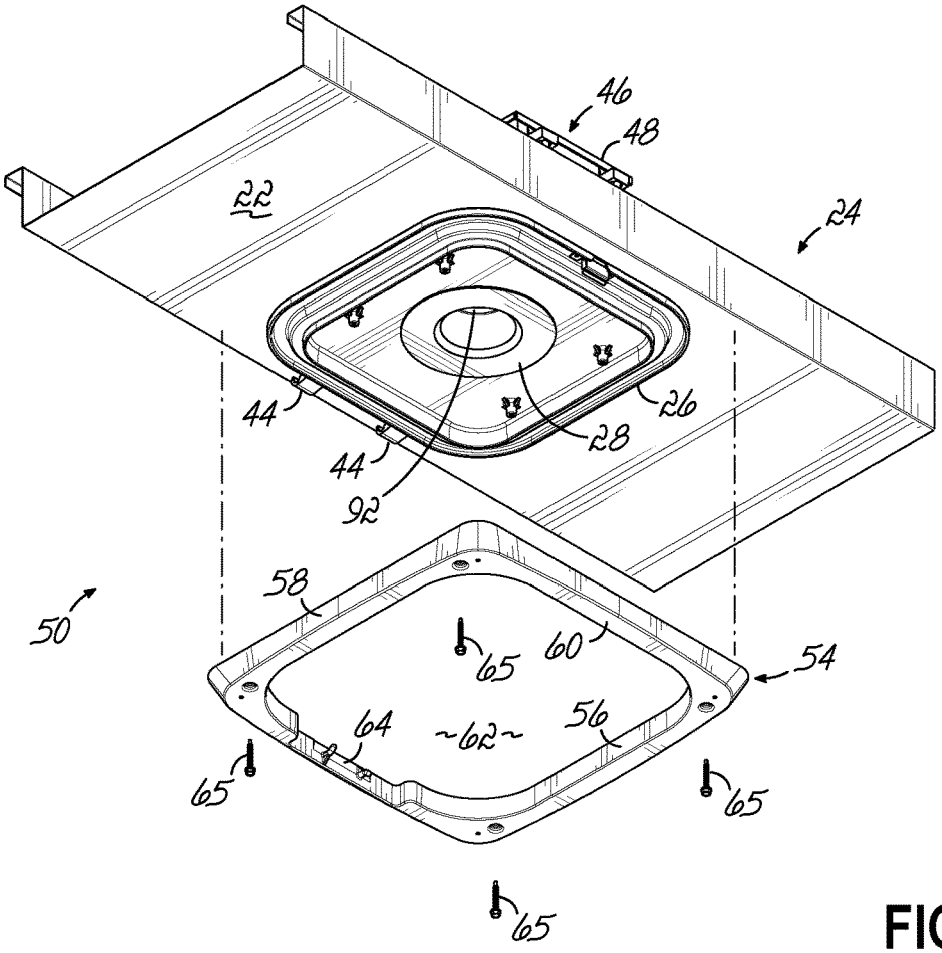
Figure 2F:
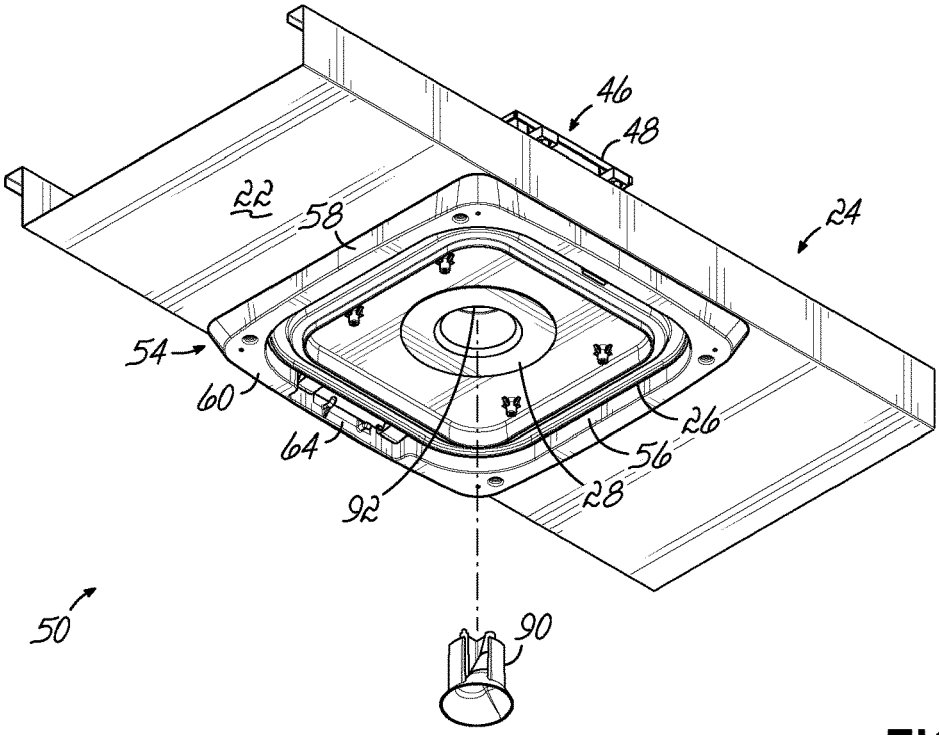
FIG. 2F illustrates mounting of a wire guide into the lamp socket housing of a canopy fixture of the SCOTTSDALE® canopy luminaire shown in FIG. 1.
Figure 3A:
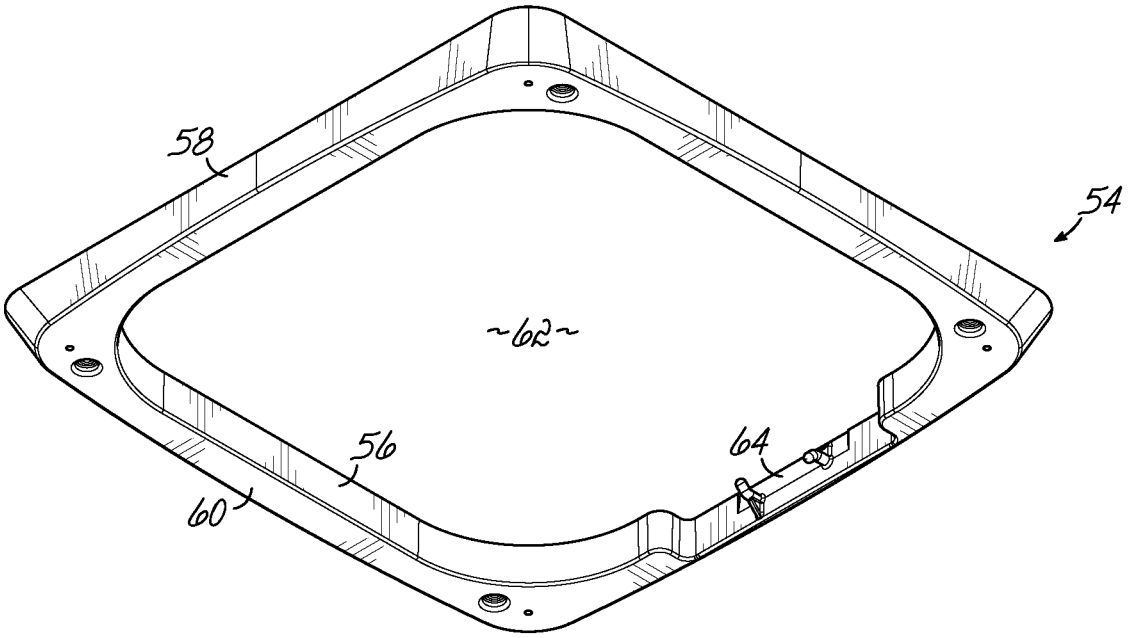
FIGS. 3A-3E illustrate various views of the retrofit adaptor bracket shown in FIGS. 2D and 2E.
Figure 3B:
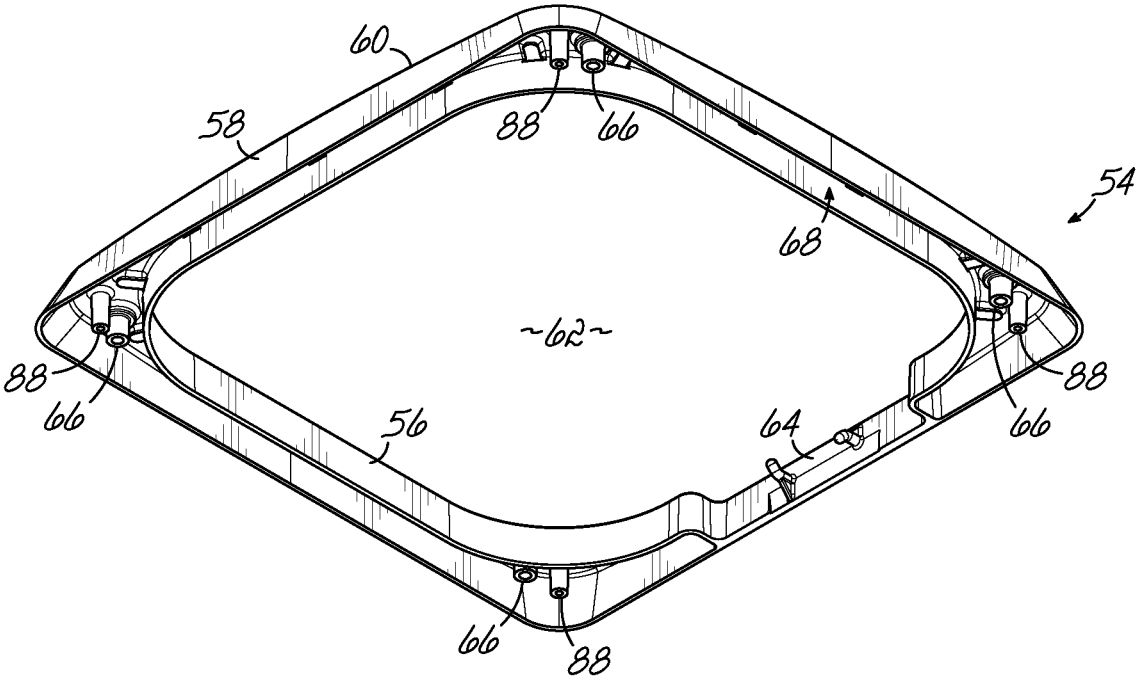
Figure 3C:
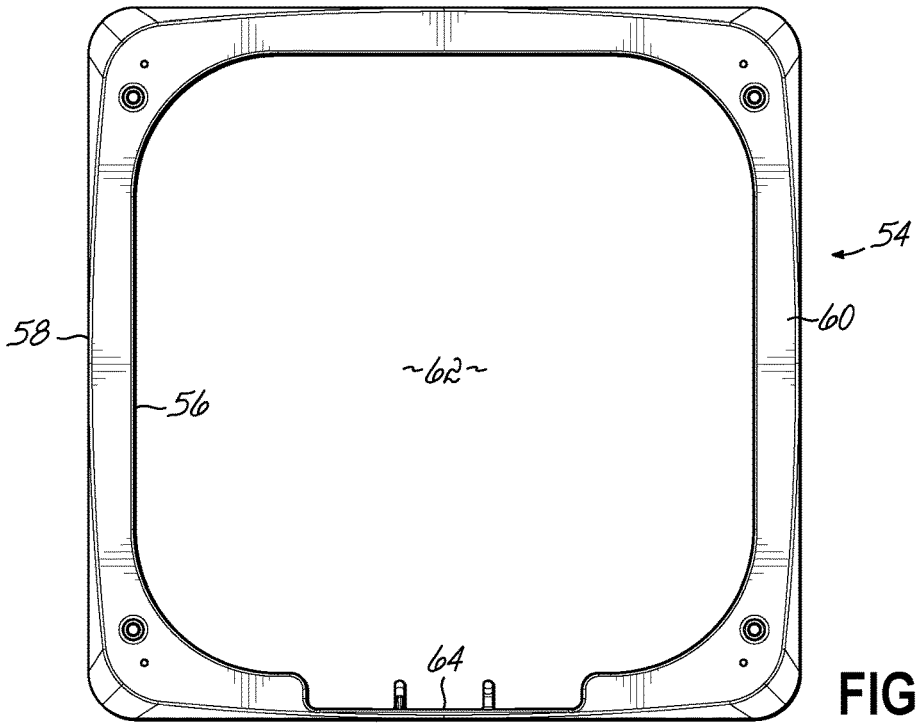
Figure 3D:
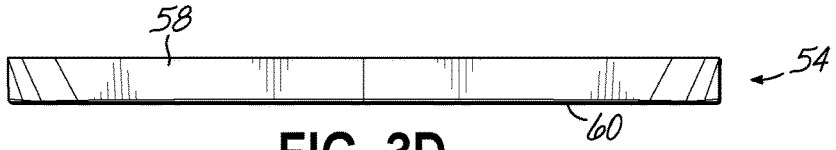
Figure 3E:
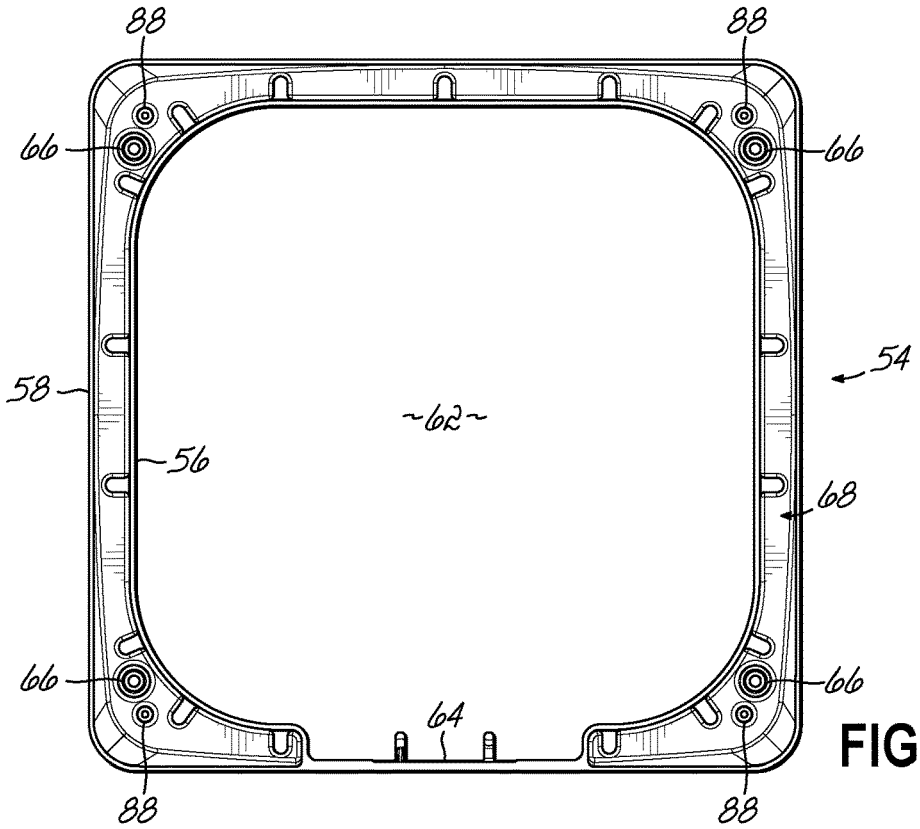

Further referring to FIGS. 3A and 3B, the retrofit adaptor bracket 54 includes four vertically oriented mounting posts 66 located within a cavity 68 defined by the inner wall 56, the outer wall 58 and the connecting web 60 which may be unthreaded and configured to receive four respective fasteners 65, such as self-drilling fasteners, to secure the retrofit adaptor bracket 54 to the canopy deck 22 as shown in FIGS. 2E and 2F according to one embodiment, with the central opening 62 of the retrofit adaptor bracket 54 receiving the fixture base 26 within the central opening 62 so that the retrofit adaptor bracket 50 surrounds the fixture base 26 as shown in FIG. 2F.

As shown in FIGS. 2G, 2H and 5-7, the retrofit LED canopy assembly 50 of the present invention includes a retrofit LED canopy luminaire 70 according to one embodiment which is shown in various stages of being mounted to the retrofit adaptor bracket 54 according to the exemplary embodiment.

In one embodiment, the retrofit LED canopy luminaire 70 may comprise the SCOTTSDALE® SCM LED canopy luminaire as shown in FIGS. 2G, 2H and 5-7 that is commercially available from the Applicant, LSI Industries, Inc. In an alternative embodiment, the retrofit LED canopy luminaire may instead comprise the SCOTTSDALE® Vertex™ SCV LED canopy luminaire 72, also commercially available from the Applicant, LSI Industries, Inc, as will be described in connection with FIGS. 9-14.

Figure 9:
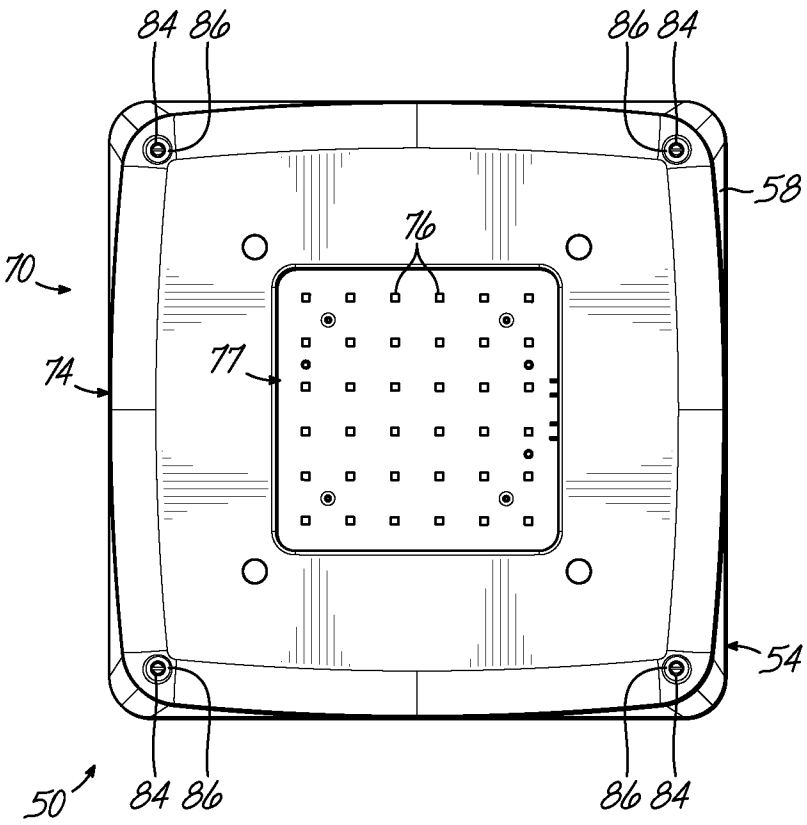
FIG. 9 is a bottom plan view of a central LED array located within the retrofit LED canopy luminaire shown in FIGS. 5-8.

As shown in FIGS. 2G, 2H and 5-7, the retrofit LED canopy luminaire 70 includes a housing 74 which encloses a central array of LED's 76 as shown in FIG. 9 that are located within an optical chamber 77 (see FIG. 9). The housing 74 supports a central lens 78, such as a clear tempered glass lens, through which light emanating from the central array of LED's 76 projects downwardly to an area located below the retrofit LED canopy luminaire 70.

Figure 2G:
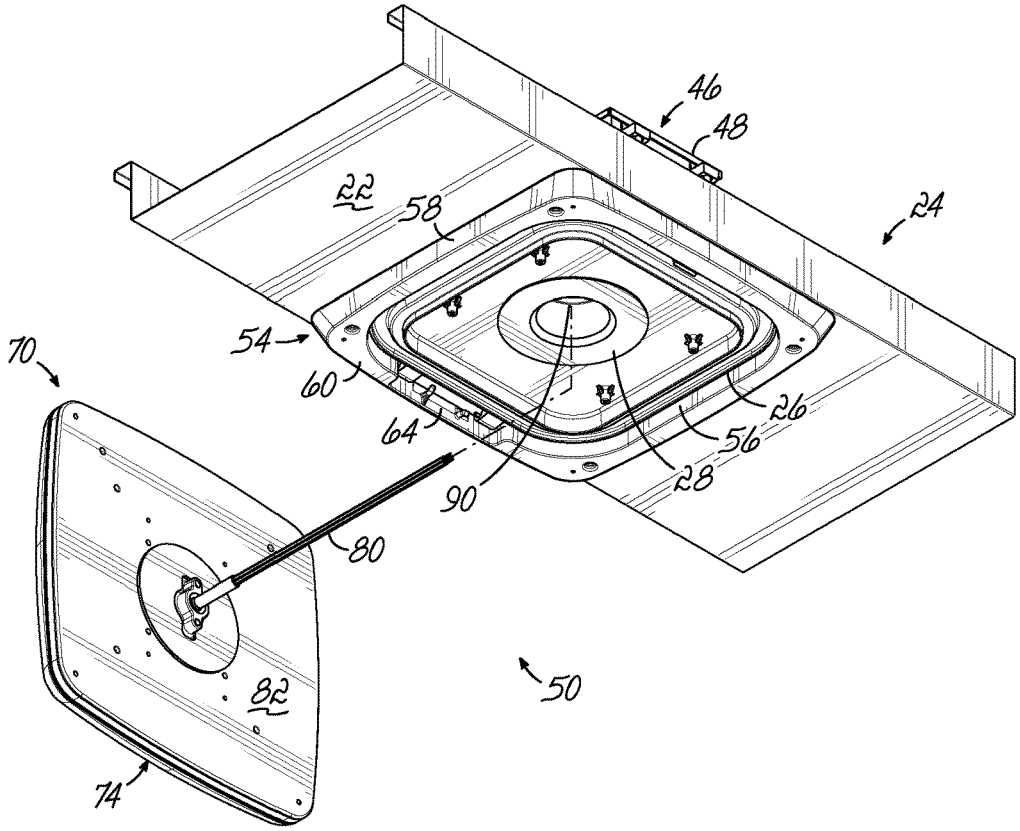
FIGS. 2G and 2H illustrate mounting of an exemplary retrofit LED canopy luminaire to the retrofit adaptor bracket shown in FIG. 2E.
Figure 6:
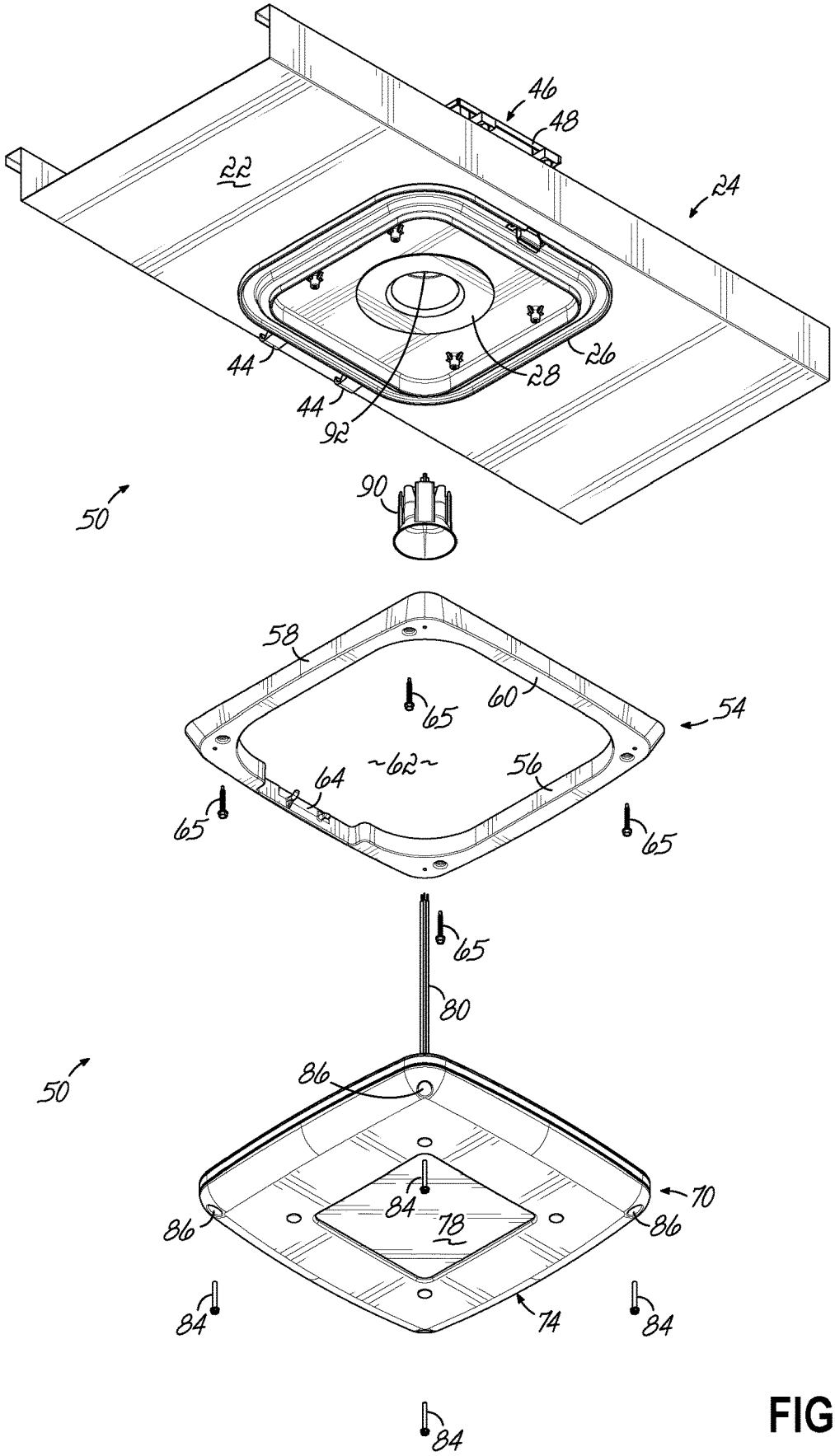
FIG. 6 is a bottom perspective view illustrating assembly and mounting of the retrofit LED canopy luminaire shown in FIG. 5.

Referring to FIGS. 2G and 6, the exemplary retrofit LED canopy luminaire 70 includes a plurality of electric leads 80 which extend from a base 82 of the retrofit LED canopy luminaire 70 and which are to be connected to respective electrical leads (not shown) extending from a remote power source (not shown) during the retrofit process as will be described in greater detail below.

In one embodiment, the retrofit LED canopy luminaire 70 has five electrical leads 80 extending from the base 82. Three of the electrical leads 80 are provided for power connection of the retrofit LED canopy luminaire 70 to three respective electrical power leads (not shown) extending from the remote power source (not shown). The three electrical leads 80 may be provided for high voltage electrical connection (i.e., 480V+/−10%) to the power electrical leads (not shown) extending from the remote power source (not shown). The retrofit LED canopy luminaire 70 may also include two optional low voltage electrical leads (i.e., 0-10V) that are electrically connected to two respective electrical leads (not shown) extending from the remote power source (not shown), as described in greater detail below for control of the retrofit LED canopy luminaire 70.

Figure 2H:
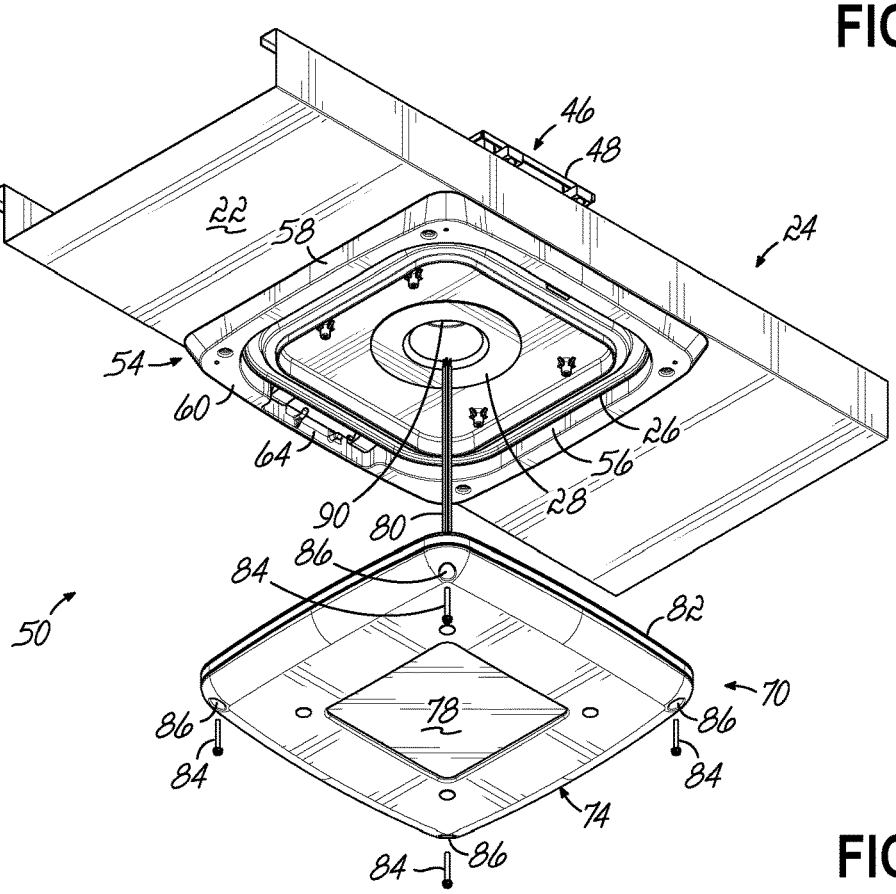

As shown in FIGS. 2H and 6, the retrofit LED canopy luminaire 70 is mounted to the retrofit adaptor bracket 54 via four fasteners 84, such as threaded machine screws, that extend through four respective apertures 86 (see FIG. 2H) that are located generally at the respective four corners of the retrofit LED canopy luminaire 70. The four fasteners 84 extending through the apertures 86 of the retrofit LED canopy luminaires are received in four vertically oriented threaded posts 88 that are located within the cavity 68 of the retrofit adaptor bracket 50 (see FIGS. 3B and 3E).

In this embodiment, the retrofit adaptor bracket 54 is mounted to the canopy deck 22 with the cavity 68 of the retrofit adaptor bracket 54 facing the canopy deck 22, and with the connecting wall 60 of the retrofit adaptor bracket 54 being spaced from the canopy deck 22.

With the lamp socket of the SCOTTSDALE® canopy luminaire already removed from the lamp socket housing 28 during the retrofit process as shown in FIG. 2C, a wire guide 90 according to one embodiment, as shown in FIG. 2F and FIGS. 4A-4G, is inserted into the lamp socket housing 28 and frictionally engaged with an inner cylindrical surface 92 (see FIG. 2F) of the lamp socket housing 28 so that the wire guide 90 is press-fit and frictionally retained within the lamp socket housing 28 as will be described in greater detail below.

As shown in FIGS. 4A-4F, the wire guide 90 according to one embodiment includes a wire guide body 94 having one or more passageways 96 (two passageways 96 shown in FIGS. 4A-4F) that extend through wire guide body 94 and are configured to route the electrical leads 80 extending outwardly from the base 82 of the retrofit LED canopy luminaire 70 as shown in FIGS. 2G, 4H and 6, through the wire guide body 94, and into the ballast housing 46 as shown in FIG. 4I and as will be described in greater detail below.

Referring now to FIGS. 4A-4H, the exemplary wire guide body 94 is made according to one embodiment from a plastic material, although other suitable materials are possible as well. In the embodiment shown in FIGS. 4A-4H, the wire guide body 94 includes the pair of at least partially separated passageways 96 that extend through the wire guide body 94 from an inlet end 98 of the wire guide body 94 to an opposite outlet end 100 of the wire guide body 94. Each of the pair of passageways 96 is configured to route selected different ones of the electrical leads 80 extending from the base 82 of the retrofit LED canopy luminaire 70 through the respective pair of passageways 96 of the wire guide body 94 and into the ballast housing 46.

According to the exemplary embodiment of FIGS. 4A-4H, the pair of at least partially separated passageways 96 include a common inlet 102 located at the inlet end 98 of the wire guide body 94 and a pair of respective outlets 104 located at the remote and opposite outlet end 100 of the wire guide body 94.

As shown in FIGS. 4A, 4E and 4F, the wire guide body 94 includes a saddle portion 106 located within the wire guide body 94 proximate the common inlet 102. The saddle portion 106 separates the common inlet 102 into the pair of at least partially separated passageways 96. For example, one of the passageways 96 may route the three high voltage power electrical leads 80 from the retrofit LED canopy luminaire 70 through the wire guide body 94, while the other passageways 96 may route the two lower voltage control electrical leads 80 also through the wire guide body 94, but separated from the high voltage electrical leads 80 extending through the other passageway. This may help to minimize interference caused by the high voltage electrical leads 80.

As will be described in greater below, the common inlet 102 and saddle portion 106 that separate the two at least partially separated passageways 96 allows an installer to essentially blindly insert the electrical leads 80 of the retrofit LED canopy luminaire 70 into the wire guide body 94, with the electrical leads 80 being routed through the wire guide body 94 and into the ballast housing 46 for electrical connection with the electrical leads (not shown) extending from the remote power source (not shown).

The electrical leads (not shown) extending from the remote power source (not shown) are routed to the ballast housing 46 via standard electrical conduit (not shown) that is mechanically coupled to one side wall of the ballast housing 46 in a known manner.

As shown in the embodiment of FIGS. 4A, 4B, 4E and 4F, the common inlet 102 of the two at least partially separated passageways 96 may be circular in transverse cross-section, and each of the pair of respective outlets 104 of the two passageways 96 may also be circular in transverse cross-section. A diameter of the common inlet 102 may be greater than a respective diameter of each of the pair of respective outlets 104.

Still referring to FIGS. 4A-4E and 4G, the exemplary wire guide body 94 includes a plurality of circumferentially spaced mounting pillars 108 (four shown in FIGS. 4A-4E and 4G) extending in a direction parallel to a longitudinal axis of the wire guide body 94. Each of the mounting pillars 108 is configured to frictionally engage with the inner cylindrical surface 92 of the lamp socket housing 28 so that the wire guide body 94 may be press-fit and frictionally retained within the lamp socket housing 28.

In the embodiment shown in FIGS. 4A-4E and 4G, each of the plurality of mounting pillars 108 comprises a respective elongated arcuate mounting tab 110 extending in a direction parallel to the longitudinal axis of the wire guide body 94 which frictionally engage with the cylindrical inner surface 92 of the lamp socket housing 28.

Each of the lamp socket housing 28 and the wire guide body 94 may include respective cooperating keying structure 112, 114 that is configured to orient the wire guide body 94 in a predetermined rotational orientation within, and relative to the lamp socket housing 28. For example, the keying structure 112 of the wire guide body 94 may include as least one pin 116 extending in a direction parallel to a longitudinal axis of the wire guide body 94 and toward a top wall 118 of the lamp socket housing 28, and the keying structure 114 of the lamp socket housing 28 may include at least one aperture 120 formed in the top wall 118 of the lamp socket housing 28 that is configured to receive the at least one pin 116 of the wire guide body 94 as shown in FIGS. 4G and 4I.

The wire guide body 94 may be funnel-shaped between the common inlet 102 and the saddle portion 106 as shown in FIGS. 4A-4D. A pair of transverse webs 122 may be provided on the wire guide body 94, with one of the transverse webs 122 extending in one direction between the pair of passageways 96, and the other of the transverse webs 122 extending in a transverse direction between the keying structure 112 provided on the wire guide body 94.

With the wire guide body 94 press-fit into the lamp socket housing 28 as shown in FIGS. 4H and 4I, the pair of outlets 104 of the two passageways 96 respectively align with two apertures 124 (see FIGS. 4G and 4I) provided on a top wall 125 of the light socket housing 28.

During the retrofit installation of the retrofit LED canopy luminaire 70, the installer inserts the electrical leads 80 extending from the retrofit LED canopy luminaire 50 into the common inlet 102 of the wire guide body 94, with the electrical leads 80 being separately guided and routed as desired through the wire guide body 94, through the pair of apertures 120 formed in the top wall 125 of the light socket housing 28, and into the ballast housing 46 for electrical connection with the electrical leads (not shown) extending from the remote power source (not shown). The two passageways 96 of the wire guide body 94 neatly group the two separated bundles of electrical leads 80 extending from the retrofit LED canopy luminaire 70 (i.e., the high voltage leads and the low voltage leads) so that they may be easily inserted by the installer through the top wall 118 of the lamp socket housing 28 and into the ballast housing 46 as shown in FIGS. 4H and 4I.

Figure 5:
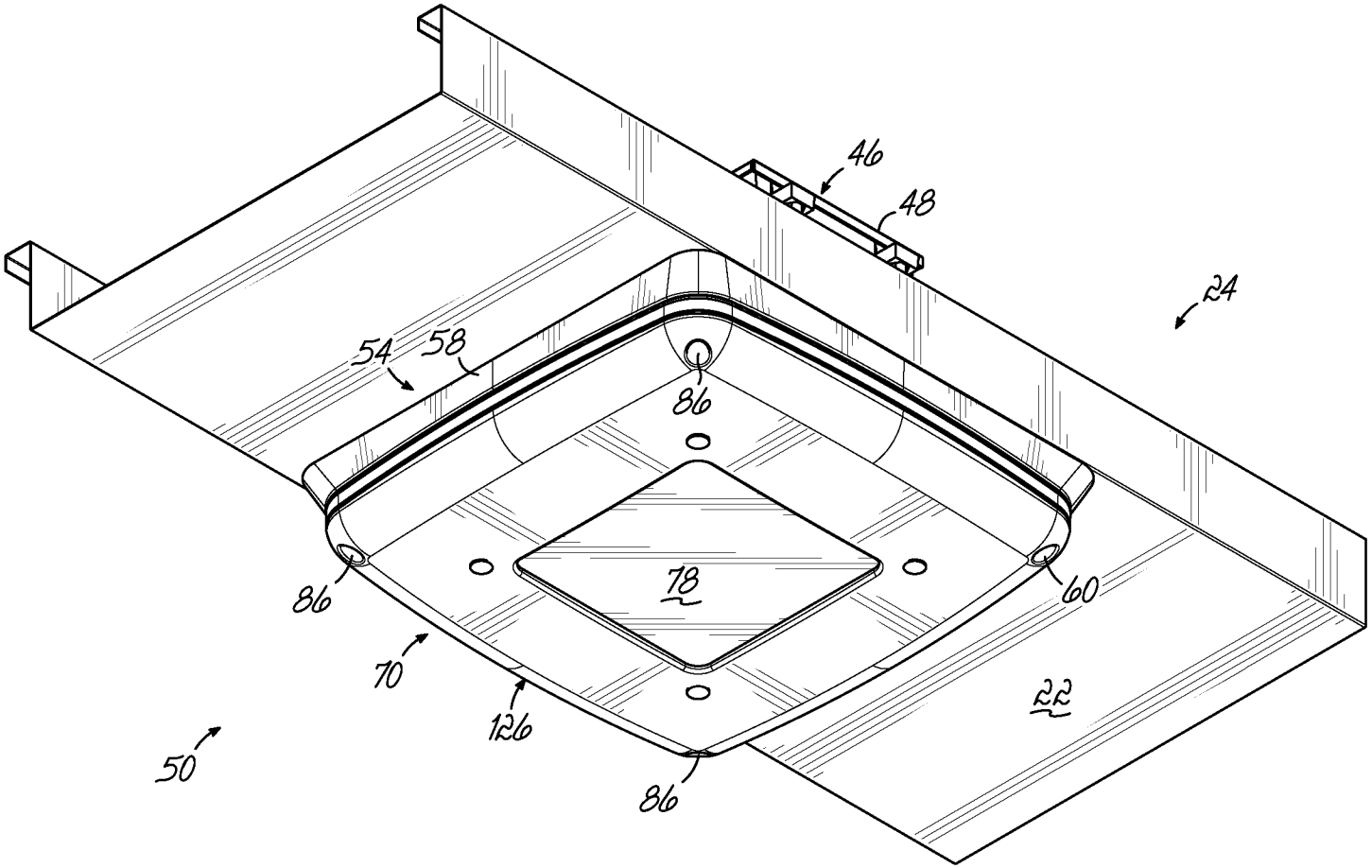
FIG. 5 is a bottom perspective view of a retrofit LED canopy luminaire according to one embodiment of the present invention.

With the retrofit LED canopy luminaire 70 securely mounted to the retrofit adaptor bracket 54, and with all of the necessary electrical connections of the respective electrical leads 80 being made within the ballast housing 46, the installation of the retrofit LED canopy luminaire 70 is complete as shown in FIGS. 5 and 7.

With the retrofit LED canopy luminaire 70 mounted to the retrofit adaptor bracket 54 as shown in FIGS. 5 and 7, the retrofit LED canopy luminaire 70 and retrofit adaptor bracket 54 provide an aesthetically pleasing appearance and a low profile for the retrofit LED canopy luminaire 70 located beneath the canopy.

In an alternative embodiment of the retrofit LED canopy luminaire 70 shown and described in connection with FIGS. 2G, 2H and 5-9, the alternative retrofit LED canopy luminaire 72 described above is shown in FIGS. 10-14 as comprising the SCOTTSDALE® Vertex™ SCV LED canopy luminaire also commercially available from the Applicant, LSI Industries, Inc.

In this alternative embodiment, like numerals represent like parts to the retrofit LED canopy luminaire assembly 50 shown and described in connection with the embodiment of FIGS. 2-9. In this embodiment, the retrofit adaptor bracket 54 is inverted as shown in FIGS. 10-12 so that the connecting wall 60 of the retrofit adaptor 54 is mounted to the canopy deck 22 with the cavity 68 of the retrofit adaptor bracket 54 facing away from the canopy deck 22.

As shown in FIGS. 10-14, the SCOTTSDALE® Vertex™ SCV LED canopy luminaire 72 includes a housing 126 enclosing an optical chamber 128 (see FIG. 14) within the retrofit LED canopy luminaire 70. The optical chamber 128 includes four distinct arrays 130 of LED's located around a central electronic control compartment 132. The housing 126 of the retrofit LED canopy luminaire 72 supports four tempered glass lenses 134 which are located beneath the respective four arrays 130 of LED's such that light emanating from the four arrays 130 of LED's is cast through the lenses 134 downwardly to the area located beneath the retrofit LED canopy luminaire 72.

Installation of the retrofit LED canopy luminaire 72 shown in FIGS. 10-14 is similar to the retrofit process as described above in connection with FIGS. 1-9, except that the retrofit adaptor bracket 54 is inverted from the previous embodiment as described above.

Figure 10:
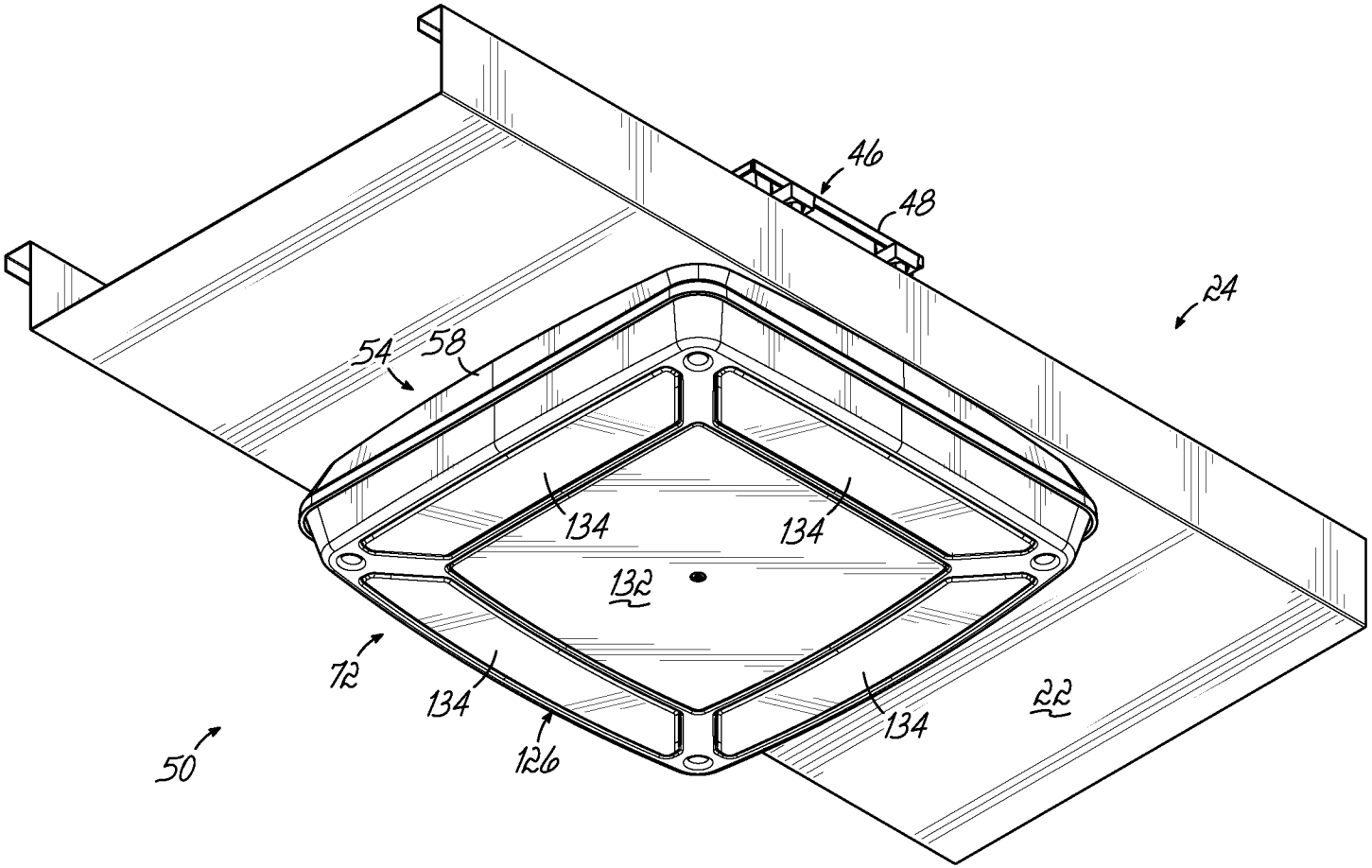
FIG. 10 is a view similar to FIG. 5 illustrating a retrofit LED canopy luminaire in accordance with an alternative embodiment of the present invention.
Figure 11:
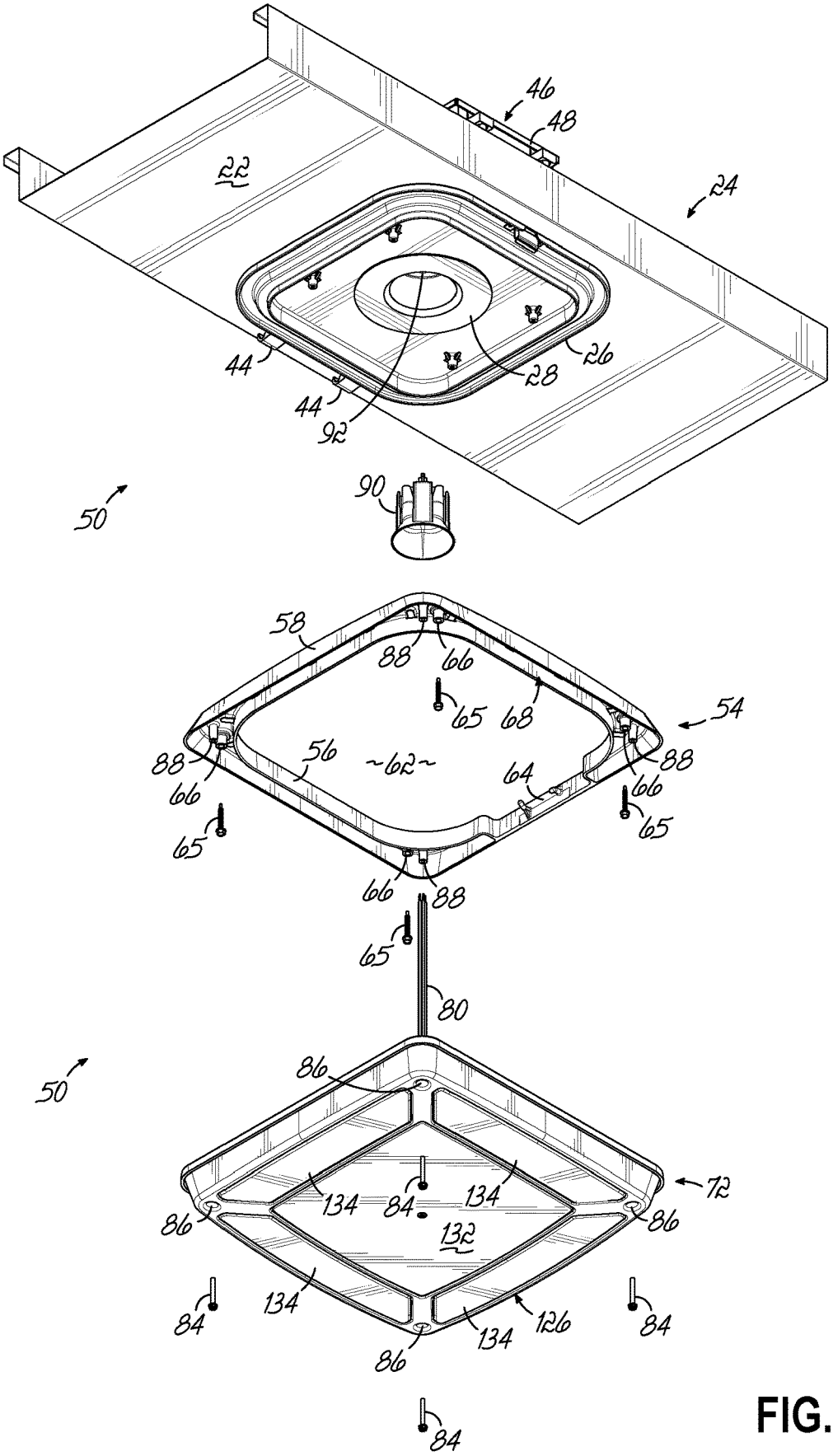
FIG. 11 is a view similar to FIG. 6 illustrating assembly and mounting of the retrofit LED canopy luminaire shown in FIG. 10.
Figure 12:
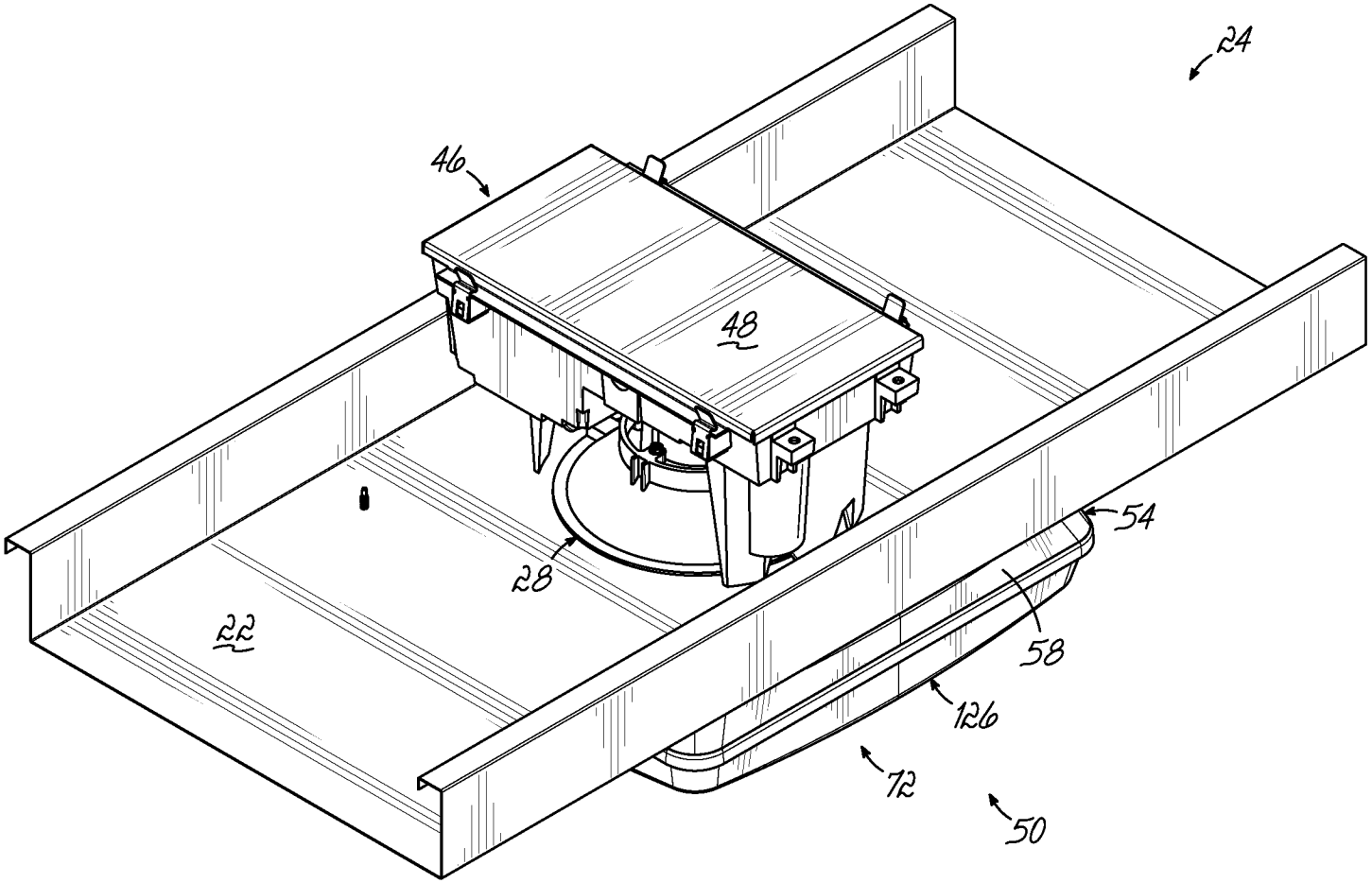
FIG. 12 is a view similar to FIG. 7 illustrating the ballast housing located above the canopy deck of the canopy shown in FIG. 1.
Figure 13:
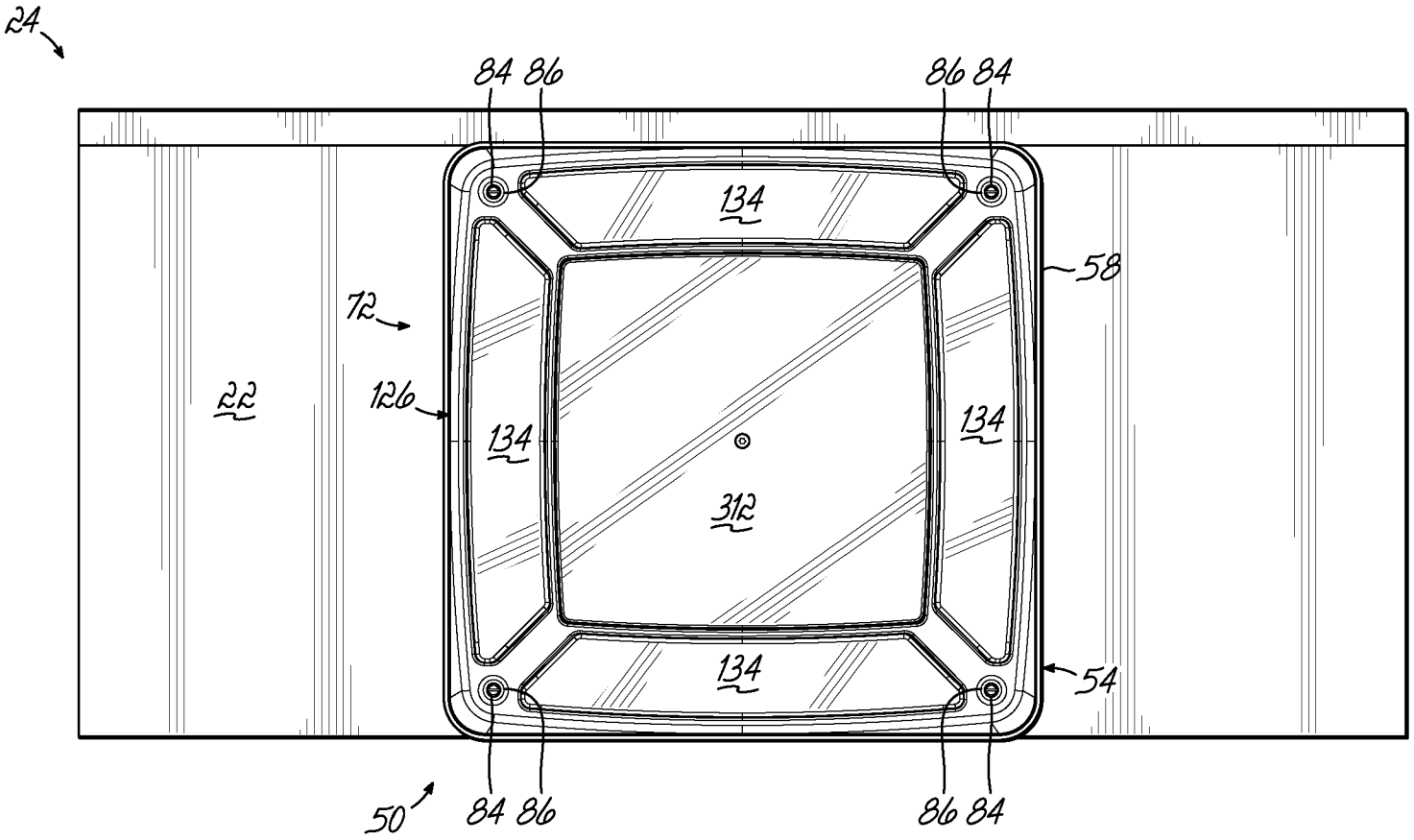
FIG. 13 is a view similar to FIG. 8 illustrating the installed retrofit LED canopy luminaire shown in FIGS. 10-12.
Figure 14:
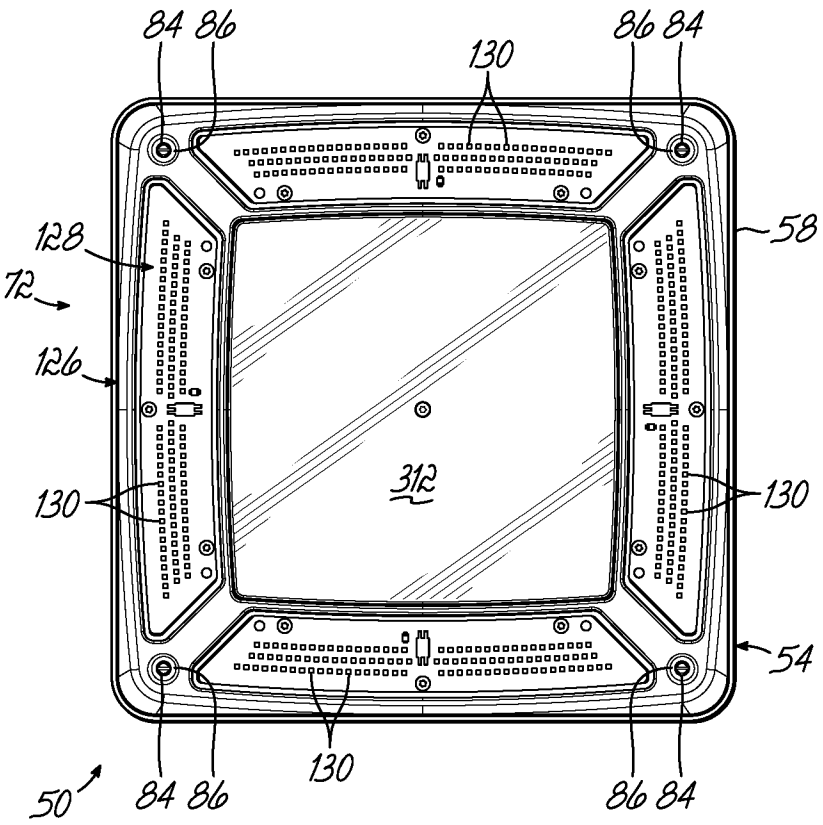
FIG. 14 is a view similar to FIG. 9 illustrating four arrays of LED's located within the retrofit LED canopy luminaire shown in FIGS. 10-13.

As with the previous embodiment, the retrofit LED canopy luminaire 72 mounted to the retrofit adaptor bracket 54 as shown in FIGS. 10, 12 and 13, provides an aesthetically pleasing appearance and a low profile for the retrofit LED canopy luminaire 72 located beneath the canopy 24.

While various aspects in accordance with the principles of the invention have been illustrated by the description of various embodiments, and while the embodiments have been described in considerable detail, they are not intended to restrict or in any way limit the scope of the invention to such detail. The various features shown and described herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope of the general inventive concept.

What is claimed is:

1. A retrofit LED canopy luminaire assembly configured for mounting with a canopy fixture supported by a canopy deck and having a fixture base located beneath the canopy deck, a lamp socket housing operatively connected to, and extending upwardly from the fixture base and through the canopy deck, and a ballast housing located above the canopy deck and operatively connected to the lamp socket housing, comprising:

a retrofit adaptor bracket defining a central opening therethrough and being configured to be mounted to the canopy deck and receive the fixture base within the central opening;

a retrofit LED canopy luminaire configured to be mounted to the retrofit adaptor bracket and having electrical leads that are electrically coupled to, and extend outwardly from, the retrofit LED canopy luminaire; and a wire guide body supported within the lamp socket housing and having at least one passageway extending therethrough configured to route the electrical leads extending outwardly from the retrofit LED canopy luminaire through the wire guide body and into the ballast housing.

2. The retrofit LED canopy luminaire assembly of claim 1, wherein the wire guide body includes a pair of at least partially separated passageways extending therethrough, each of the pair of passageways being configured to route selected different ones of the electrical leads through the respective pair of passageways of the wire guide body and into the ballast housing.

3. The retrofit LED canopy luminaire assembly of claim 2, wherein the pair of at least partially separated passageways include a common inlet located at one end of the pair of passageways and a pair of respective outlets located at remote opposite ends of the respective pair of passageways.

4. The retrofit LED canopy luminaire of claim 3, wherein the wire guide body includes a saddle portion located within the wire guide body proximate the common inlet, wherein the saddle portion separates the common inlet into the pair of at least partially separated passageways.

5. The retrofit LED canopy luminaire of claim 4, wherein the wire guide body is funnel-shaped between the common inlet and the saddle portion.

6. The retrofit LED canopy luminaire of claim 3, wherein the common inlet is circular in transverse cross-section.

7. The retrofit LED canopy luminaire of claim 6, wherein each of the pair of respective outlets is circular in transverse cross-section.

8. The retrofit LED canopy luminaire of claim 7, wherein a diameter of the common inlet is greater than a respective diameter of each of the pair of respective outlets.

9. The retrofit LED canopy luminaire of claim 1, wherein the wire guide body includes a plurality of circumferentially spaced mounting pillars extending in a direction parallel to a longitudinal axis of the wire guide body and each being configured to frictionally engage with an inner cylindrical surface of the lamp socket housing.

10. The retrofit LED canopy luminaire of claim 9, wherein each of the plurality of mounting pillars comprises a respective elongated arcuate mounting tab extending in a direction parallel to the longitudinal axis of the wire guide body.

11. The retrofit LED canopy luminaire of claim 1, wherein each of the lamp socket housing and the wire guide body includes respective cooperating keying structure configured to orient the wire guide body in a predetermined rotational orientation within the lamp socket housing.

12. The retrofit LED canopy luminaire of claim 11, wherein the keying structure of the wire guide body includes as least one pin extending in a direction parallel to a longitudinal axis of the wire guide body and toward an end wall of the lamp socket housing, and the keying structure of the lamp socket housing includes at least one aperture formed in the end wall of the lamp socket housing that is configured to receive the at least one pin of the wire guide body.

13. A wire guide for use with a canopy fixture supported by a canopy deck and having a fixture base located beneath the canopy deck, a lamp socket housing operatively connected to, and extending upwardly from the fixture base and through the canopy deck, and a ballast housing located above the canopy deck and operatively connected to the lamp socket housing, comprising:

a wire guide body supported within the lamp socket housing and having at least one passageway extending therethrough configured to route electrical leads that are electrically coupled to, and extend outwardly from, a retrofit LED canopy luminaire to be mounted with the canopy fixture, through the wire guide body and into the ballast housing.

14. The wire guide of claim 13, wherein the wire guide body includes a pair of at least partially separated passageways extending therethrough, each of the pair of passageways being configured to route selected different ones of the electrical leads through the respective pair of passageways of the wire guide body and into the ballast housing.

15. The wire guide of claim 14, wherein the pair of at least partially separated passageways include a common inlet at one end of the pair of passageways and a pair of respective outlets located at remote opposite ends of the respective pair of passageways.

16. The wire guide of claim 15, wherein the wire guide body includes a saddle portion located within the wire guide body proximate the common inlet, wherein the saddle portion separates the common inlet into the pair of at least partially separated passageways.

17. The wire guide of claim 16, wherein the wire guide body is funnel-shaped between the common inlet and the saddle portion.

18. The wire guide of claim 15, wherein the common inlet is circular in transverse cross-section.

19. The wire guide of claim 18, wherein each of the pair of respective outlets is circular in transverse cross-section.

20. The wire guide of claim 19, wherein a diameter of the common inlet is greater than a respective diameter of each of the pair of respective outlets.

21. The wire guide of claim 13, wherein the wire guide body includes a plurality of circumferentially spaced mounting pillars extending in a direction parallel to a longitudinal axis of the wire guide body and each being configured to frictionally engage with an inner cylindrical surface of the lamp socket housing.

22. The wire guide of claim 21, wherein each of the plurality of mounting pillars comprises a respective elongated arcuate mounting tab extending in a direction parallel to the longitudinal axis of the wire guide body.

23. The wire guide of claim 13, wherein each of the lamp socket housing and the wire guide includes respective cooperating keying structure configured to orient the wire guide body in a predetermined rotational orientation within the lamp socket housing.

24. The wire guide of claim 23, wherein the keying structure of the wire guide body includes as least one pin extending in a direction parallel to a longitudinal axis of the wire guide and toward an end wall of the lamp socket housing, and the keying structure of the lamp socket housing includes at least one aperture formed in the end wall of the lamp socket housing that receives the at least one pin of the wire guide body.

25. A method of retrofitting a canopy luminaire having a canopy fixture supported by a canopy deck and including a fixture base located beneath the canopy deck, a lamp socket housing operatively connected to, and extending upwardly from the fixture base and through the canopy deck, a lamp socket supported within the lamp socket housing, a high intensity discharge (HID) lamp mounted in the lamp socket, a reflector supported beneath the fixture base through which a portion of HID lamp extends, a frame and lens assembly movably connected to the fixture base and enclosing the HID lamp, and a ballast housing located above the canopy deck and operatively connected to the lamp socket housing, the method comprising the steps of:

disconnecting and removing the frame and lens assembly from the fixture base;

removing the HID lamp from the lamp socket;

removing the reflector from the fixture base;

removing the lamp socket from the lamp socket housing;

mounting a retrofit adaptor bracket defining a central opening therethrough to the canopy deck with the fixture base received within the central opening;

supporting a wire guide body having at least one passageway extending therethrough within the lamp socket housing;

providing a retrofit LED canopy luminaire having electrical leads that are electrically coupled to, and extend outwardly from, the retrofit LED canopy luminaire;

routing the electrical leads extending outwardly from the retrofit LED canopy luminaire through the at least one passageway of the wire guide body and into the ballast housing; and mounting the retrofit LED canopy luminaire to the retrofit adaptor bracket.

* * * * *